US012077935B2

(12) United States Patent
Crowson et al.

(10) Patent No.: US 12,077,935 B2
(45) **Date of Patent: *Sep. 3, 2024**

(54) MATERIAL HANDLING SYSTEMS AND METHODS

(71) Applicant: WING MARINE LLC, Montgomery, TX (US)

(72) Inventors: John Crowson, Lovelady, TX (US); Mel Friedman, Montgomery, TX (US); Douglas W. Thompson, Amarillo, TX (US); Peter Crossland, Atenas (CR)

(73) Assignee: WING MARINE LLC, Montgomery, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/517,056

(22) Filed: Nov. 22, 2023

(65) Prior Publication Data

US 2024/0084549 A1 Mar. 14, 2024

Related U.S. Application Data

(63) Continuation of application No. 17/996,999, filed as application No. PCT/US2021/032797 on May 17, 2021, now Pat. No. 11,828,042.

(Continued)

(51) Int. Cl.
*E02F 3/88* (2006.01)
*E02F 3/90* (2006.01)

(Continued)

(52) U.S. Cl.
CPC ..... *E02F 5/125* (2013.01); *E02F 3/907* (2013.01); *E02F 5/107* (2013.01); *E02F 7/065* (2013.01)

(58) Field of Classification Search
CPC . E02F 5/125; E02F 3/907; E02F 5/107; E02F 7/065; E02F 3/8866; E02F 5/104; E02F 3/88; E02F 3/8875; E02F 5/28
See application file for complete search history.

(56) References Cited

U.S. PATENT DOCUMENTS 400,936 A 4/1889 Morris
615,414 A * 12/1898 Stead ..... E21B 7/122 175/9

(Continued)

FOREIGN PATENT DOCUMENTS

EP 0328198 A1 8/1989
GB 2222425 A * 3/1990 ..... E02F 3/88

(Continued)

OTHER PUBLICATIONS

Eddy Pump Corporation, "Eddy Pump Specifications", pp. 1-5, downloaded from the Internet May 17, 2020, Eddy Pump Corporation, El Cajon, California (USA).

(Continued)

*Primary Examiner* — Edwin J Toledo-Duran
(74) *Attorney, Agent, or Firm* — Jeffrey L. Wendt; THE WENDT FIRM, P.C.

(57) ABSTRACT

Systems and methods include a wing tool configured to be operable from work vessel(s), the wing tool including thrusters capable of fluidizing sediments from a first seabed location and moving it to a second seabed location, the second seabed location including a trench or differently shaped collection sump previously made by the wing tool and/or an extraction pump. The extraction pump operates from a second work vessel having sufficient capacity to pump fluidized sediments from the trench. Certain systems include a separation unit that separates sand from silts and clays and water from collected sediment. Systems and methods for reclamation of reservoirs, moving sand waves, (Continued)

for pre-trenching and/or recovering marine pipelines and cables, for removing cover from marine archaeological sites and for disposing of contaminated bottom materials in an environmentally acceptable manner.

20 Claims, 15 Drawing Sheets

Related U.S. Application Data

(60) Provisional application No. 63/029,672, filed on May 25, 2020.

(51) Int. Cl.
*E02F 5/10* (2006.01)
*E02F 5/12* (2006.01)
*E02F 7/06* (2006.01)

(56) References Cited

U.S. PATENT DOCUMENTS 1,477,679 A 12/1923 Woolley
2,242,940 A 5/1941 Caoli
3,010,232 A 11/1961 Skakel et al.
3,036,393 A 5/1962 Baird, Jr.
3,357,506 A 12/1967 Bosredon
3,698,573 A 10/1972 Wolters
3,762,078 A 10/1973 Wetherbee
3,889,403 A * 6/1975 Gauthier ..... E21C 50/00 43/4.5
3,949,497 A 4/1976 Crump
3,967,393 A * 7/1976 Nixon ..... E02F 7/04 405/224.1
4,187,625 A * 2/1980 Duval ..... E02F 9/06 37/340
4,250,034 A 2/1981 Wolters
4,365,509 A 12/1982 Comelis
4,373,278 A 2/1983 Myrick
4,398,362 A * 8/1983 Weinert ..... F04F 1/16 37/366
4,418,484 A 12/1983 Wolters
4,429,476 A 2/1984 Wakefield
4,503,629 A * 3/1985 Uchida ..... E02F 7/005 37/313
4,574,501 A 3/1986 Sloan
4,979,322 A 12/1990 Sloan
5,020,858 A 6/1991 Nishikawa
5,083,386 A 1/1992 Sloan
5,275,733 A 1/1994 Burnham
5,285,587 A 2/1994 Krenzler
5,417,861 A 5/1995 Burnham
5,603,171 A 2/1997 Steinkuhler
6,125,560 A * 10/2000 Beaumont ..... E02F 5/287 37/344
6,325,924 B1 * 12/2001 Zaiger ..... E02F 5/28 210/220
6,374,519 B1 * 4/2002 Beaumont ..... E02F 5/107 37/307
6,406,510 B1 6/2002 Burnham
7,897,831 B2 3/2011 Birdwell
8,193,115 B2 6/2012 Birdwell
9,223,025 B2 12/2015 DeBrunner et al.
9,382,143 B2 7/2016 Chen
9,506,218 B2 11/2016 Manchester
9,745,715 B2 8/2017 Horton
10,000,905 B2 6/2018 Leverty
10,260,344 B2 * 4/2019 Van Doesburg ..... E02F 7/00
11,828,042 B2 11/2023 Crowson et al.
2002/0039520 A1 * 4/2002 Zaiger ..... E02F 5/28 405/128.75
2003/0041483 A1 * 3/2003 Redding ..... E02F 5/28 37/311
2003/0172557 A1 * 9/2003 Myers, Jr. ..... E02F 3/925 37/315
2006/0150445 A1 * 7/2006 Redding ..... E02F 3/9206 37/317
2006/0151631 A1 * 7/2006 Redding ..... E02F 9/06 239/383
2007/0166107 A1 * 7/2007 Jacobsen ..... E02F 3/8866 405/185
2008/0068926 A1 * 3/2008 Chambers ..... G01S 15/96 367/87
2009/0036728 A1 2/2009 Birdwell
2009/0284068 A1 * 11/2009 Yu ..... E02F 5/006 299/10
2010/0303558 A1 * 12/2010 Incoronato ..... E02F 7/00 383/105
2011/0010967 A1 * 1/2011 Howard ..... E02F 5/006 37/313
2011/0099859 A1 * 5/2011 Stewart ..... E02F 3/9206 37/344
2011/0203338 A1 8/2011 Birdwell
2011/0309668 A1 * 12/2011 Efthymiou ..... E02F 3/8866 299/17
2012/0234552 A1 * 9/2012 Vaughan ..... E02F 3/907 37/313
2013/0038113 A1 * 2/2013 Wakita ..... E02F 3/8866 299/39.2
2013/0139415 A1 * 6/2013 Halkyard ..... E02F 3/90 37/307
2013/0239869 A1 * 9/2013 Hesse ..... E02F 3/9243 362/477
2013/0241263 A1 * 9/2013 Jones ..... E02F 5/006 299/9
2013/0298430 A1 * 11/2013 Jones ..... E02F 3/8866 37/313
2013/0312296 A1 * 11/2013 Jones ..... E02F 7/06 37/317
2014/0041262 A1 * 2/2014 Espinasse ..... E02F 7/005 37/313
2014/0245930 A1 9/2014 Chen
2014/0283421 A1 9/2014 Manchester
2015/0345292 A1 * 12/2015 Smith ..... E02F 7/10 299/9
2016/0153169 A1 * 6/2016 Van Doesburg ..... E02F 3/907 37/308
2016/0168992 A1 * 6/2016 Van Doesburg ..... E21B 43/36 37/195
2016/0244942 A1 8/2016 Horton
2018/0051440 A1 2/2018 Leverty
2018/0187395 A1 * 7/2018 Nagata ..... E02F 3/905
2018/0266074 A1 * 9/2018 Halkyard ..... E02F 7/005
2018/0298754 A1 * 10/2018 Kodaira ..... B63B 22/24
2020/0080282 A1 3/2020 Bath
2022/0145756 A1 * 5/2022 Vagata ..... G08G 3/00

FOREIGN PATENT DOCUMENTS

GB 2222425 A 3/1998
GB 2315787 A 11/1998
WO WO198907691 A1 8/1989
WO WO2005002735 A2 1/2005
WO WO2008062219 A1 5/2008
WO WO2021242554 A1 12/2021

OTHER PUBLICATIONS

Triflow International, "Containerized Solids Control Equipment", pp. 1-4, (2017), Triflow International, Willis, Texas (USA).
Newton Labs, "An Introduction to Newton Labs", pp. 1-51, downloaded from the Internet on or about May 17, 2020, Newton Labs, Seattle, Washington, (USA).
"AN9003—A User's Guide to Intrinsic Safety", retrieved from the Internet Jul. 12, 2017.
Rotech, "RS1-LD Jet Trencher", pp. 1-2, retrieved from the Internet Jan. 20, 2020, Rotech Subsea, Aberdeen, United Kingdom.
Bleier et al., "Low-Cost 3D Laser Scanning in Air or Water Using Self-Calibrating Structured Light", The International Archives of

(56) References Cited

OTHER PUBLICATIONS the Photogrammetry, Remote Sensing and Spatial Information Sciences, vol. XLII-2/W3, 2017, pp. 105-112.
WIPO, International Preliminary Report on Patentability, PCT/US2021/032797, pp. 1-10, Nov. 17, 2022.

* cited by examiner

MATERIAL HANDLING SYSTEMS AND METHODS

CROSS-REFERENCE TO RELATED APPLICATIONS

This application is entitled to and claims the benefit of earlier filed provisional application Ser. No. 63/029,672, filed May 25, 2020, under 35 U.S.C. § 119(e), and claims benefit under 35 U.S.C. § 120 to U.S. nonprovisional patent application Ser. No. 17/996,999, filed Oct. 24, 2022, which was a national stage filing of Patent Cooperation Treaty Application No. PCT/US21/32797, filed May 17, 2021, to which this application also claims priority, and which earlier filed provisional application, nonprovisional patent application, and PCT application are incorporated by reference herein in their entirety.

BACKGROUND INFORMATION

Technical Field

The present disclosure relates to apparatus, systems, and methods in the marine environment, including, but not limited to, dredging, underwater excavating, seabed trenching, sand wave relocation, pre-trenching, recovery of marine pipelines and cables, removing cover from marine archeological sites, environmentally acceptable disposal of contaminated bottom materials and the like. More particularly, the present disclosure relates to apparatus, systems, and methods useful for precision dredging.

Background Art

Conventional dredging operations are principally performed using one of two dredging techniques. Suction dredging in which a vessel raises sediment to the surface using a suction tube. An example of this technique is discussed in U.S. Pat. No. 10,000,095. As explained therein, dredges (i.e., dredging-type watercraft) are commonly used to remove sediments, vegetation, and/or debris, from the bottom areas of various types of bodies of water. Such bottom areas are herein described as "water-beds." For example, dredges may remove silt from a riverbed, sand from a seabed, or other materials from other types of water-beds. Dredges typically comprise a hull which floats on top of the water. A boom with a cutterhead can be pivotally attached to the hull. As such, when the cutterhead is in a lowered position, i.e., with the cutterhead positioned adjacent to the water-bed, the cutterhead can be operated in combination with a pump to stir up and remove a slurry of water-bed material from the body of water. Traditional dredges have implemented cutterheads that include a rotatable cutterbar within a shroud. With the cutterhead positioned adjacent to the water-bed, the rotatable cutterbar grinds into the water-bed and churns water-bed material, such that the water-bed material can be fluidized with the surrounding liquid to form a slurry. In addition, traditional dredges have also included pumps fluidly connected to the cutterhead, such as via a back side of the shroud, such that the dredge is capable of pumping the slurry away from the dredge to a barge or to an adjacent shoreline.

Clam shell dredges are also frequently used. Their mode of operation is discussed in U.S. Pat. Nos. 4,373,278; 3,762,078; 3,949,497; 2,242,940; 3,036,393; 1,477,679; 3,357,506; and 400,936.

A third, less commonly used, dredging operation is called water injection dredging (WID). This technique fluidizes the bottom material but provides minimal directional force to relocate the material. Absent lateral force generated by the dredging unit, the fluidized sediment fills in bottom depressions only in the direction of the prevailing current, reducing widespread use of this method. A bottom slope also affects the behavior of the sediment wave.

The systems and methods of the present disclosure provide significant advantages over these three established dredging methods.

As explained in U.S. Pat. No. 6,374,519, European patent EP-A-0328198 describes a method of dredging comprising lowering a casing of a wing shape downwardly towards the area to be cleared, the casing carrying thrust means arranged so that the thrust means is directed downwardly, the orientation of the wing casing being adjusted in the water so that it presents a surface relative to the flow which causes a resultant downward vertical component of force to counteract the upward force provided by the thrust means, the thrust means also directing a lateral wash of water towards the areas to be cleared so that the turbulence created clears the sand, silt or like material covering the area. This method of dredging may be useful for providing a trench across the sea bed. The wing shape casing is towed along a line above the sea bed and the thrust means, which is directed downwards, excavates a trench in the sea bed of a width which depends upon the material of the sea bed, its altitude above the sea bed, the power in the thrusters, its speed over the sea bed, and its pitch angle. In a typical example, the width of trench formed will be of the same order as the width of the wing shape casing. Such a dredger, which is commonly known as a "wing dredger" has been successful in producing a trench of a width sufficient to take a pipeline or, alternatively, to flatten an area of seabed in preparation for works on the seabed. Reference is also made to EP-0419484 and GB 2315787 which describe wing dredgers is further detail. The wing dredger is normally suspended below the surface support vessel by means of cables. U.S. Pat. No. 6,374,519 describes use of a wing dredger that is not supported from the surface vessel, avoiding problems associated with waves causing heaving of the vessel.

Conventional dredging techniques move the vessel to the in-situ material for extraction. As may be seen, current practices may not be adequate for all circumstances. There remains a need for more robust, agile systems and methods for dredging, particularly for systems and methods employing a wing dredge suspended from an agile support vessel to move fluidized dredged material to a predetermined extraction area where a second vessel transfers the fluidized material to either a transport barge or to a nearby deposit site. Stated differently, there remains a need in the art for the introduction of material movement as a separate step in the maintenance dredging process and the separation of material movement from extraction (removal from the water) steps. Moreover, there is a need in the art for systems and methods that are effective at relocating large quantities of accumulated sediments in confined areas such as vessel berths. There is also a need for systems and methods that reduce or avoid disruptive maneuvering normally required by conventional dredging vessels. It would be advantageous if systems and methods could be developed that utilize a fluidized sediment technique that introduces a settling period between material arrival and extraction pumping during which gravitational settlement of the dredged material creates a denser extraction stream with less water. It would further be advantageous if the independent collection and extraction processes are also coordinated to minimize vessel maneuvering and interference between movement and extraction operations, and transforms the collection and extraction of dredged material from the intermittent process typical of traditional mechanical dredging to a continuous process, that are suitable for operation in inland, coastal and offshore waters, and that do not use cutters or teeth to move sediment so integrity of underwater pipelines and cables and the like are not threatened. It would be further advantageous to provide systems and methods suffering minimal disruption due to debris and trash within the sediment being dredged, and with road mobility for access to remote bodies of water (reservoirs), or to aid in rapid response to a distant emergency (for example, hurricane disruption) more rapidly. The systems and methods of the present disclosure are directed to one or more of these needs.

SUMMARY

In accordance with the present disclosure, material handling systems and methods of using same are described which reduce or overcome many of the faults of previously known material handling systems and methods.

A first aspect of the disclosure is a system comprising:

a) a wing tool configured to be operable from a first work vessel and comprising one or more thrusters capable of fluidizing sediments from a first seabed location and moving (we sometimes use the word relocating) the fluidized sediments to a second seabed location, the second seabed location including a depression (for example, but not limited to, a trench) previously made by the wing tool or an extraction pump;

b) the extraction pump operable from a second work vessel having sufficient capacity to pump at least a portion of the fluidized sediments from the depression and form a collected sediment comprising sand, fine grain materials (silts and clays), and water; and c) optionally, a separation unit (mobile or non-mobile) that separates the sand from the fine grain materials (silts and clays) and water from the collected sediment (separation unit(s) may be located either on shore or on a floating barge or vessel).

Certain system embodiments may comprise multiple wings, multiple extraction pumps and/or multiple separation units. In certain embodiments, the structure of the wing tool is made more efficient, lighter and less expensive by incorporation of a structural framework that may be plated on all sides except the top of a center section to allow free motion of a gimbal, single point suspension. In certain embodiments the wing tool may be an all-plate design. In certain embodiments the wing tool may be suspended from a vessel by a four point suspension system; however, certain other embodiments may incorporate a single point suspension wing tool that, through hydraulic or electrically driven screw turnbuckles mounted on the wing tool, can pitch and roll the unit during submerged operation from controls on the vessel. Certain system embodiments may comprise one or more wing tool orientation components comprising a set or sets of cables, winches, and chains.

Certain system embodiments may comprise one or more umbilicals for powering, controlling, and/or communicating with the one or more wing tools. Certain system embodiments may comprise one or more modular separation units, which may in certain embodiments be containerized. In certain system embodiments the first work vessel and/or the second work vessel may comprise a hull that may be disassembled and transportable by rail, or alternatively by one or more trucks. Certain system embodiments may comprise a human-machine interface (HMI). In certain system embodiments the separation unit may be connected to the extraction pump by connectors that may be selected from the group consisting of flange couplings, QC/QDC couplings, cam and groove (CAMLOCK) fittings, and threaded fittings. In certain embodiments the one or more wing tools, extraction pump, and separation unit may be wirelessly operated, or only some of these. Certain system embodiments may comprise one or more acoustic, laser, and/or optical sensors, cameras, or lights located on the one or more wing tools, for example to observe and to navigate around bottom obstructions, sense tool location, orientation and depth, effectiveness of material movement, turbidity, metal sensors, ultrasonic transponders (transmitter/receiver) sensors, radar scanners (to sense presence of cables and pipelines, archeological sites, sunken vessels). Certain embodiments may comprise computer-aided maneuvering of the wing tool in seven dimensions: pitch (angle of attack), roll, yaw (heading vs. yaw of the service vessel), height above the sediment surface, rotational speed of the thruster propeller, direction and speed of the service vessel. Certain embodiments may comprise fully automatic computerized operation of the wing tool from a work vessel.

Certain embodiments may comprise one or more work vessels other than the first and second work vessels, for example scows and barges for placement of collected sediments. In these embodiments, the systems may comprise auxiliary equipment such as tanks, pumps, gas separators, and the like. Certain embodiments may include small vessels or floats that carry boost pumps to extend the range of the primary extraction pump or to operate independently to remove sediment as required. In certain embodiments the system may further include one or more computer navigation systems, for example positioned on the first work vessel. In certain systems the navigation system may include a global positioning system (GPS). In certain embodiments where road/rail mobility may be essential to relocate the entire system quickly and inexpensively, a vessel that can be broken into modules for transport to remote locations is employed and considered within the present systems and methods. Such a vessel has three purposes:

- to support the wing tool during tow to the site; the wing tool will be suspended in the water during tow to gain the lowest possible center of gravity for best vessel stability; this also allows all lifting gear to be low to the water;
- to position and maneuver itself to put the wing tool in the right place and with the correct attitude to maximize the amount of sediment moved (in certain embodiments, volume of sediment moved can be maximized by incorporating systems that sense, and compensate for, the composition and density of the sediment); and
- to support total process efficiency by agility during maneuvers to minimize lost time during operations; although, in certain embodiments, all system instructions come from the vessel (it is manned), instrumentation on the wing tool will produce the information which allows the boat to adjust itself to achieve optimum wing tool performance. The primary purpose of the vessel is to place the wing tool in the optimum location and at the best orientation to maximize sediment movement. One strategy for reducing cost may be stockpiling sediment by the wing tool for later extraction (at environmentally permitted quantities) after the wing tool (expensive unit) is demobilized. In this strategy, the extraction pump/vessel would remain in place throughout the year and could be operated in a totally unmanned condition since there would be no surprises in the stockpiled materials that could lead to disruptions to the pump/vessel disruption. Also, the wing tool would only be recalled when the stockpile required replenishment which could extend cycles of stockpiling beyond a "standard" year frequency. In certain embodiments, one or more additional tools may be fitted to the wing tool for the purpose of locating underwater debris (like uprooted trees in reservoirs), washing the sediment from around it (exposing it) and removing it with grabber type tools to open lower reservoir outlets.

A second aspect of the disclosure is a method comprising:

forming a first fluidized material in a first seabed location (for example, a portion of seabed spaced from and roughly parallel to a dock) by fluidizing a depression (for example, but not limited to, a trench) using a first wing tool or extraction pump, the depression thus formed serving as a collection area for material extracted from a second seabed location (for example a seabed space adjacent a dock face), and to identify debris that could obstruct the extraction pump;

forming a second fluidized material and moving it away from the second seabed location (dock face) using the first wing tool or a second wing tool while the extraction pump extracts at least a portion of the first fluidized material from the depression formed in the first seabed location and delivers the at least a portion of the first fluidized material to a surface vessel; and moving the second fluidized material into the depression using the first wing tool while the extraction pump extracts at least a portion of the second fluidized material from the depression and delivers the at least a portion of the second fluidized material to the surface vessel or other support vessel.

Certain method embodiments may comprise multiple wings, multiple extraction pumps and/or multiple separation units to accelerate the process. Certain method embodiments may comprise multiple booster pumps may to extend the operating distance to a more remote land based sediment disposal area. Certain method embodiments may comprise forming a third fluidized material at a third seabed location (for example, a ship or "federal" channel) and moving it into the trench using the first wing tool while the pump extracts at least a portion of the third fluidized material from the trench and delivers the at least a portion of the third fluidized material to the surface vessel, the other support vessel, or another vessel. In certain embodiments the wing tool may be operated remotely via wired or wireless communication. In certain other embodiments the wing tool may be operated locally via on-board batteries, an on-board motor, and a programmable logic controller. In certain embodiments the wing tool may be configured to operate in modes selected from the group consisting of continuous mode and periodic mode. Certain embodiments may comprise a software module including one or more algorithms for calculating parameters selected from the group consisting of volume of dredged materials in a dredged materials hopper, scow, or barge, rate of removal of dredged materials from a target area, rate of accumulation of dredged materials in a trench, topography of dredged materials in the trench, density and/or turbidity of fluidized sediments, maximization of volumes of sediment of different compositions moved, and other environmental conditions that can affect system effectiveness, and combinations thereof.

Systems and methods of the present disclosure are presented for easily and safely fluidizing a depression in a water-bed, both in open waters and sheltered waters, and moving material into and removing the material from the depression. Certain embodiments may include additional tools for locating, and possibly removing, underwater debris (like trees, cars, shopping trolleys and wire ropes) after it is exposed by blowing the covering sediment away. A good example would be grabbers to remove trees that clog up the outlets to reservoirs after sediment is blown away. Currently performed by divers, which is very expensive and very unsafe. Major markets to be served include, but are not limited to, subsea pipeline associated, harbors and waterways, and inland reservoirs. Different embodiments of the present systems and methods are applicable to all three markets with one exception: for open waters, the wing tool (sometimes referred to under the trade designation Wing Fluidizer™) is composed of three substructures, sections, or pieces for offshore work (heavier mass, more stability in open waters). For remediation of harbors, waterways and reservoirs, we have determined that only the center structural section which contains the thruster units and instrumentation are necessary. Therefore, in certain embodiments, the wing tool may be devoid of end structural sections, as further explained herein. The additional mass is not required for stability as vessel motions are much reduced in sheltered waters. Other methods, including relocating sand waves, pre-trenching and recovering marine pipelines and cables, removing cover from marine archaeological sites, and creating bottom containment depressions and, after relocating contaminated materials into those depressions, covering that contaminated material with environmentally acceptable materials, and deposition and movement of sediment for the purpose of nourishing intertidal zones, mudflats and marshes, are further aspects of the disclosure and described herein.

These and other features of the systems and methods of the present disclosure will become more apparent upon review of the brief description of the drawings, the detailed description, and the claims that follow. It should be understood that wherever the term "comprising" is used herein, other embodiments where the term "comprising" is substituted with "consisting essentially of" are explicitly disclosed herein. It should be further understood that wherever the term "comprising" is used herein, other embodiments where the term "comprising" is substituted with "consisting of" are explicitly disclosed herein. Moreover, the use of negative limitations is specifically contemplated; for example, certain systems and methods may comprise a number of physical components and features but may be devoid of certain optional hardware and/or other features. For example, certain systems may be devoid of auxiliary work vessels, pumps, and other equipment. As another example, systems of this disclosure may be devoid of navigation systems, GPS, or other expensive equipment. In yet another example, systems of the present disclosure may be devoid of hydrocyclones, or devoid of any separation unit. Certain systems may be devoid of extraction pumps, and certain methods may be devoid of extraction steps. Certain wing tools may be devoid of end structural sections.

BRIEF DESCRIPTION OF THE DRAWINGS

The manner in which the objectives of this disclosure and other desirable characteristics can be obtained is explained in the following description and attached drawings in which:

It is to be noted, however, that FIGS. 1-17 of the appended drawings may not be to scale and illustrate only typical system embodiments, or components of systems in accordance with this disclosure. Furthermore, FIGS. 18-23 illustrate only six of many possible methods of this disclosure. Therefore, the drawing figures are not to be considered limiting in scope, for the disclosure may admit to other equally effective embodiments. Identical reference numerals are used throughout the several views for like or similar elements.

DETAILED DESCRIPTION

Figure 1:
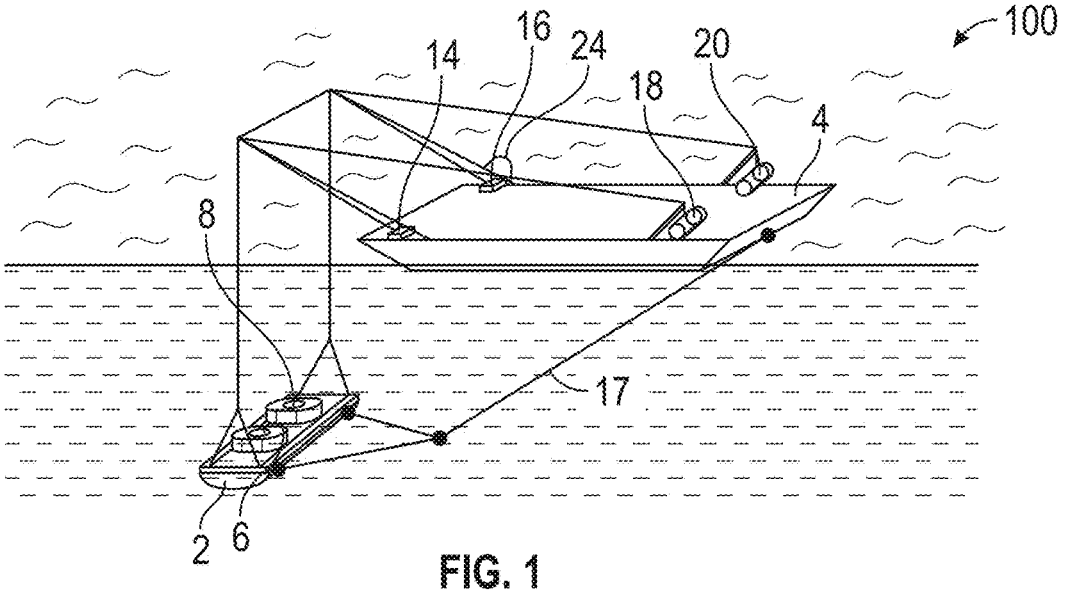
FIG. 1 is a perspective schematic illustration view of a wing work vessel and wing material movement tool useful in systems and methods of the present disclosure.

In the following description, numerous details are set forth to provide an understanding of the disclosed systems and methods. However, it will be understood by those skilled in the art that the systems and methods disclosed herein may be practiced without these details and that numerous variations or modifications from the described embodiments may be possible. All U.S. published patent applications and U.S. patents referenced herein are hereby explicitly incorporated herein by reference, irrespective of the page, paragraph, or section in which they are referenced. Where a range of values describes a parameter, all subranges, point values and endpoints within that range are explicitly disclosed herein. This document follows the well-established principle that the words "a" and "an" mean "one or more" unless we evince a clear intent to limit "a" or "an" to "one." For example, when we state "a wing tool configured to be operable from a first work vessel and comprising one or more thrusters", we mean that the specification supports a legal construction of "a wing tool" that encompasses structure distributed among multiple physical structures, and a legal construction of "a first work vessel" that encompasses structure distributed among multiple physical structures.

The present disclosure describes apparatus, systems, and methods for moving fluidized material from one subsea location to another location, and in some embodiments removal of the material from the subsea environment to a disposal or a separation facility. Systems of this disclosure employ a wing material movement tool (sometimes referred to herein simply as a "wing tool"), suspended from an agile support vessel, to move the dredged material to a predetermined extraction area where a second vessel transfers the fluidized material to either a transport barge or to a nearby deposit site. The introduction of material movement as a separate step or feature in the maintenance dredging process and the separation of material movement from extraction (removal from the water) steps are unique features of systems and methods of the present disclosure. Combinations of multiple wings and support vessels, pumps and support vessels, disposal barges and/or separation systems may be combined into coordinated systems and methods of this disclosure to complete various work scopes.

Systems and methods of the present disclosure feature one or more wing material movers or tools. The wing tool is an innovation to the dredging industry. It is particularly effective at moving large quantities of accumulated sediments in confined areas such as vessel berths. A wing tool, together with a separate extraction pump, performs the role normally filled by a single extraction vessel. However, systems and methods of the present disclosure more than compensate for this apparent lack of efficiency in several ways. Through use of a wing tool and a support vessel dedicated to the wing tool, systems and methods of the present disclosure are uniquely configured to avoid much of the disruptive maneuvering normally required by conventional dredging vessels. Instead, the wing tool moves material in swaths measuring from about 5 to about 20 ft. over long runs by using directional turbidity to fluidize and move the sediment. Certain embodiments may comprise a "gang" configuration of wing tools similar to those used to mow wide median strips next to major highways or to snow-plow major highways where each wing would be controlled by a separate vessel. In certain "shallow water" embodiments, a comparatively smaller wing may be employed. A wing with more than two thrusters is also feasible, but these embodiments may require a large vessel which would defeat the purpose of working in small spaces and making road transport impractical. The minimum swath of about 5 feet wide may be produced by employing a wing tool with a single thruster cone diameter.

Certain system and method embodiments of the present disclosure employ an extraction vessel operating independently of the wing tool(s) to pump the moved or relocated material to either a transport barge or nearby deposit site. Process efficiency is enhanced by providing a settling period between material arrival in the depression, collection area, or trench and extraction pumping from that depression during which gravitational settlement of the dredged material creates a denser extraction stream with less water. The independent collection and extraction processes may also be coordinated to minimize vessel maneuvering and interference between movement and extraction operations. Although systems and methods of this disclosure may operate in intermittent mode (batch or semi-continuous modes), the wing tool(s) and separate extraction pump(s) allow continuous collection and extraction of dredged material.

The primary features of the systems and methods of the present disclosure will now be described with reference to the drawing figures, after which some of the construction and operational details, some of which are optional, will be further explained. The same reference numerals are used throughout to denote the same items in the figures.

FIG. 1 is a perspective schematic illustration view of an embodiment 100 comprising a wing work vessel 4, sometimes referred to herein as a first vessel, and wing material movement tool 2 useful in systems and methods of the present disclosure. Wing tool 2 includes a port and starboard thrusters 6, 8, port thruster stabilizers 10A, 10B, and starboard thruster stabilizers 12A, 12B. In embodiment 100, first vessel 4 includes port and starboard wing suspension winches 14, 16, and port and starboard A-frame winches 18, 20, as well as an A-frame rotation mechanism 24. A power and instrument umbilical (not illustrated) would also be included connecting wing tool 2 and first vessel 4. Work vessel 4 is illustrated schematically moving forward or stationary heading into a tidal flow. The tidal flow may be in a river, estuary, or at sea. Wing tool 2 is suspended at an appropriate distance from the sediment via a pair of cables operated by winches 14, 16, one cable extending from each side of vessel 4 and there is provided a further cable 17 from adjacent the bow of vessel 4.

Figure 2:
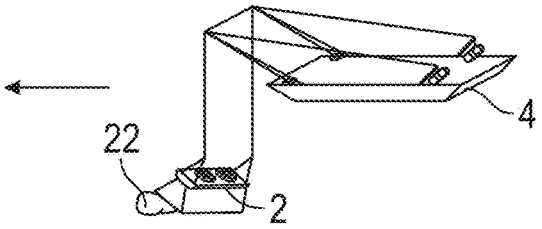
FIGS. 2 and 3 are perspective schematic illustration views of two possible modes of operation of the wing material movement tool illustrated schematically in FIG. 1.
Figure 3:
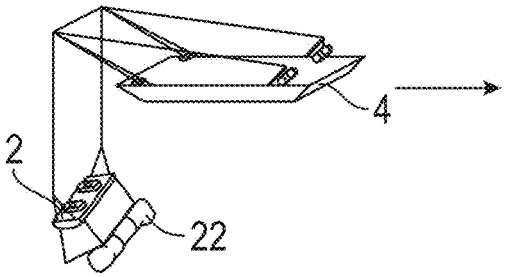

FIGS. 2 and 3 are perspective schematic illustration views of two possible modes of operation of the wing material movement tool illustrated schematically in FIG. 1, with FIG. 2 illustrating a "bulldozer" mode of operation, while FIG. 3 illustrates a "tractor" mode of operation. In each of FIGS. 2 and 3 the arrow indicates direction of movement of first vessel 4, wing tool 2, and a cylindrical fluidized bed of material 22, and wing tool 2 is tilted so as to allow port and starboard thrusters 6, 8 to create movement of the cylindrical fluidized bed of material.

Figure 4:
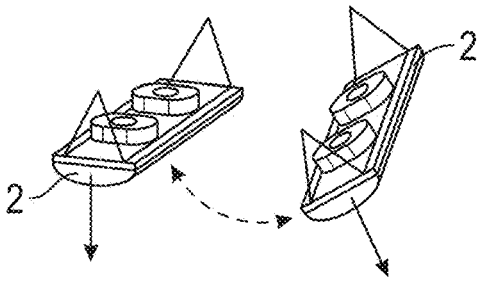
FIGS. 4, 5, and 6 are perspective schematic illustration views of three possible adjustments for optimal material movement by the wing material movement tool illustrated schematically in FIG. 1.
Figure 5:
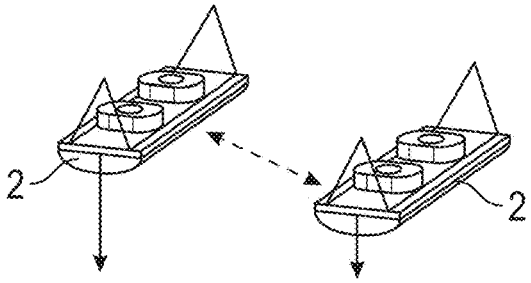
Figure 6:
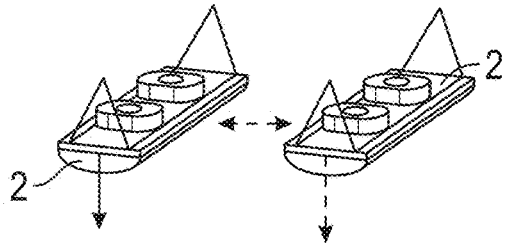

FIGS. 4, 5, and 6 are perspective schematic illustration views of three possible adjustments for optimal material movement by the wing material movement tool illustrated schematically in FIGS. 1, 2, and 3. FIG. 4 illustrate lateral movement; FIG. 5 illustrates altitude movement; and FIG. 6 illustrates adjustment of power of the thrusters may be adjusted (the solid arrow indicating more power than the dotted line arrow).

Figure 7:
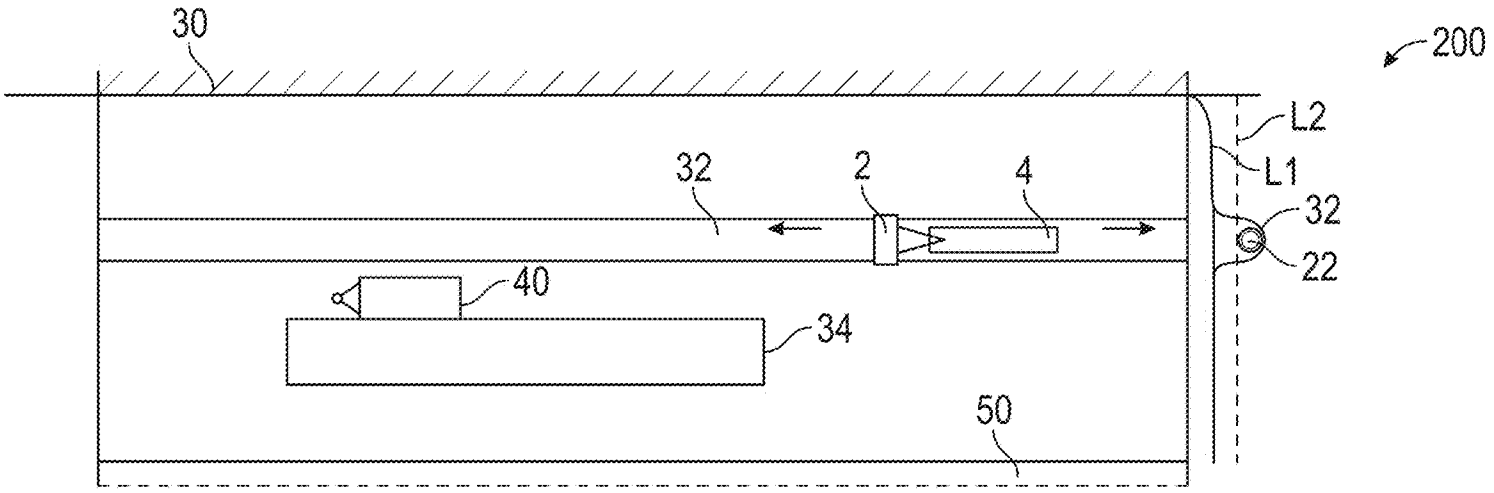
FIGS. 7, 8, 9, and 10 are schematic plan illustration views of one system and method embodiment in accordance with systems and methods of the present disclosure.
Figure 8:
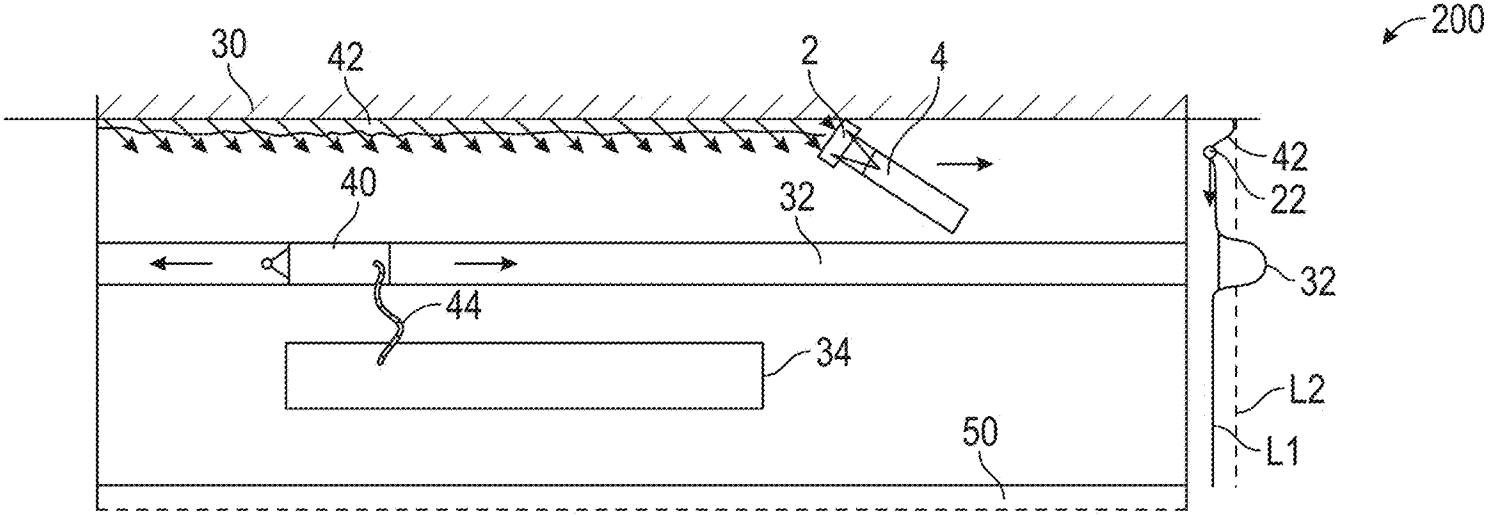
Figure 9:
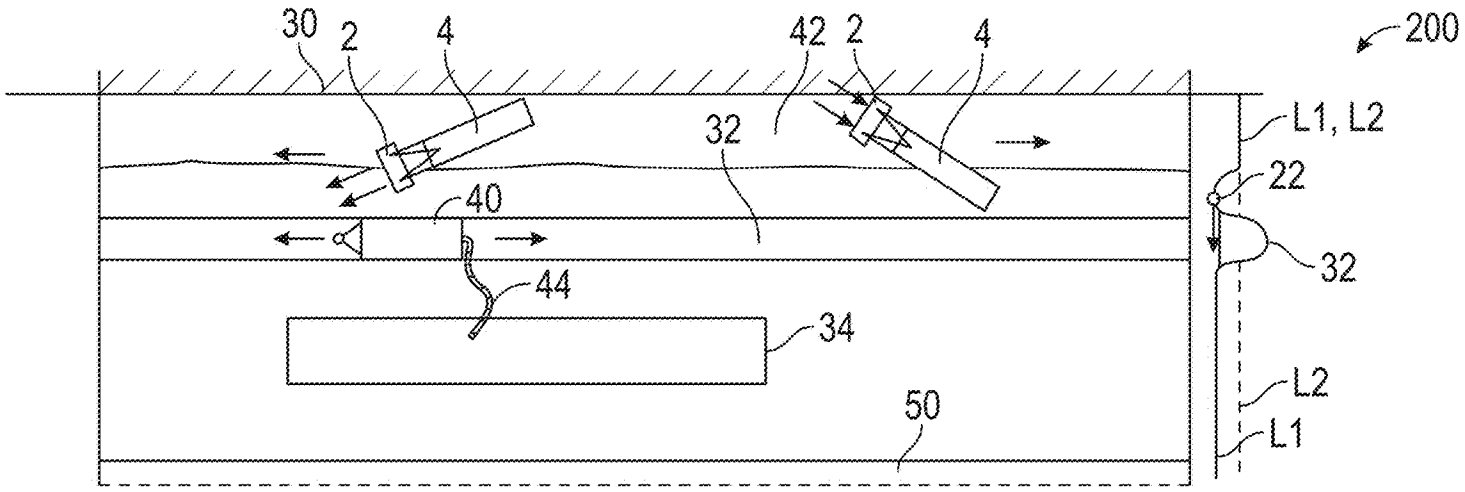
Figure 10:
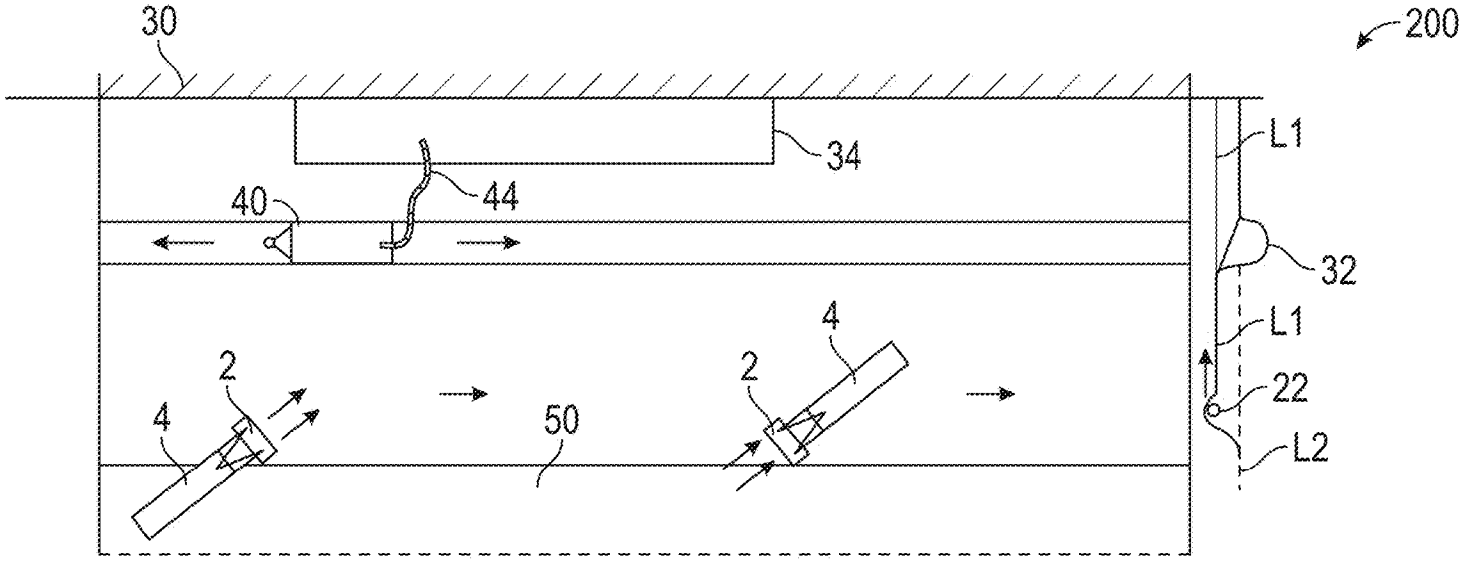

FIGS. 7, 8, 9, and 10 are schematic plan illustration views of one system and method embodiment in accordance with systems and methods of the present disclosure. FIG. 7 illustrates a first step, a first depression or trench 32 is formed by wing tool 2 and first vessel 4. A hopper or barge 34 acts as a second vessel, and an extraction pump 40 is idle at this stage. A vessel unloading area 30 (such as on a wharf) is illustrated, and as illustrated in the graph to the right of FIG. 7, a silted area of reduced depth exists adjacent vessel unloading area 30. The graph also illustrates a level of depression of trench 32, a line L1 represents pre-dredged birth level, and dashed line L2 indicates dredged level. A federal channel 50 is also illustrated, as will be explained herein. FIG. 8 illustrates wing tool 2 and first vessel 4 excavating the silted, reduced depth area adjacent the wharf, forming a second trench 42, and further illustrates extraction pump 40 pumping silt, sand, and other dredged materials onto barge or hopper (second vessel) 34 via an extraction pump discharge conduit 44. FIG. 9 illustrates a fulling dredged second trench 42, and wing tool 2 and first vessel 4 moving in the direction of horizontal arrows, with the cylindrical fluidized bed of material moving in a direction indicated by non-horizontal arrows toward first trench 32. Finally, FIG. 10 illustrates wing tool 2 and first vessel 4 excavating the federal channel 50 (on the left the wing tool 2 and first vessel 4 operating in bulldozer mode, while on the right side they operate in tractor mode). The primary difference between FIGS. 9 and 10 is that second vessel 34 moves from below first trench 32 to above first trench 32 to accommodate wing tool 2 and support vessel 4 which simultaneously move from above to below first trench 32. Material from federal channel is moved into second trench 42, and extraction pump 40 pumps material out of second trench 32 via extraction pump discharge conduit 44 onto or into second vessel 34. Material from second vessel may then be moved onshore for feeding to one or more separation units (not illustrated) for one-phase, two-phase, or three-phase separation.

Figure 11:
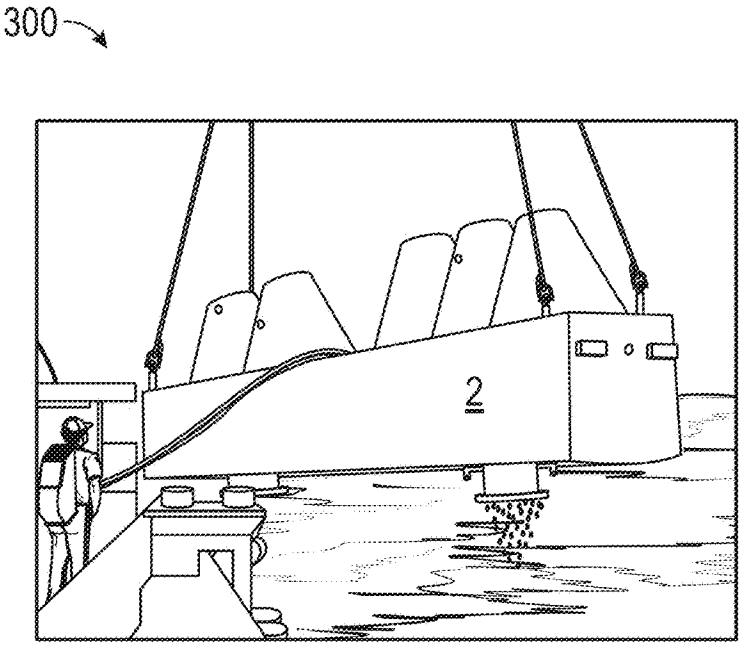
FIG. 11 is a perspective schematic illustration view of a wing tool useful in systems and methods of the present disclosure being retrieved onto a work vessel, with the sheltered water (vs open water) configuration of the tool being shown.

FIG. 11 is a schematic perspective view of a wing material movement tool 300 useful in systems and methods of the present disclosure being retrieved onto a work vessel, with the sheltered water (vs. open water) configuration of the tool being shown.

Figure 12:
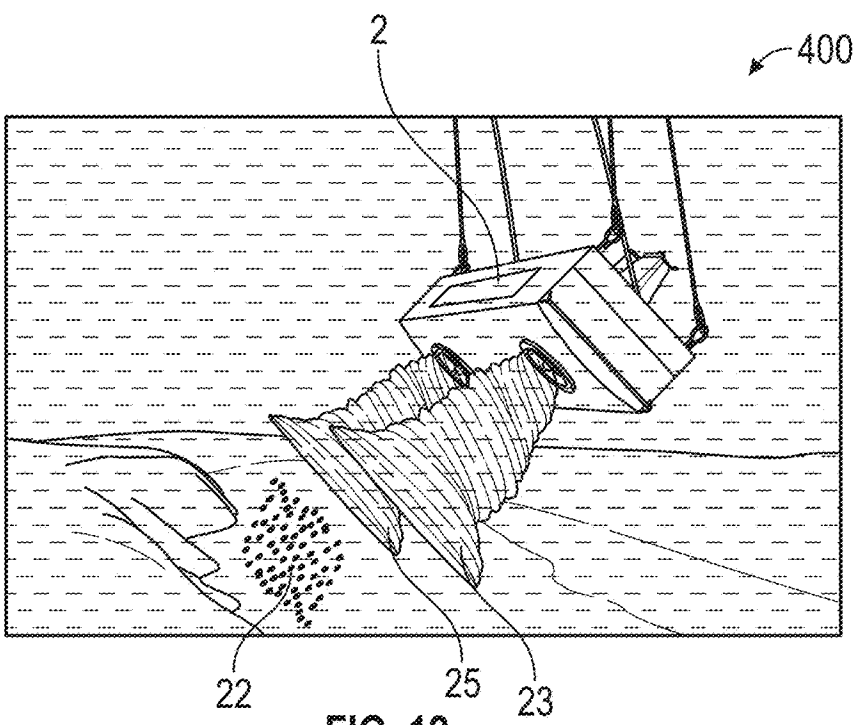
FIG. 12 is a perspective schematic illustration view of the wing tool of the type shown in FIG. 11 being employed to form a fluidized material in accordance with systems and methods of the present disclosure.

FIG. 12 is a perspective schematic illustration view of a wing tool 400 of similar type as shown in FIG. 11 being employed to form a cylindrical fluidized bed of material 22 in accordance with systems and methods of the present disclosure. As explained in U.S. Pat. No. 6,374,519, wing tool 400 is provided with two closed vertical bores which are laterally spaced from each other, each housing a thruster in the form of a motor driven propeller mounted substantially in the plane of wing tool 400 and the two propellers are driven in opposition to reduce the effects of centrifugal/centripetal forces. Two contra-rotating vertical jet vortices 23, 25 are created and where they meet, very high forces are created which increase sediment penetration.

Figure 13A:
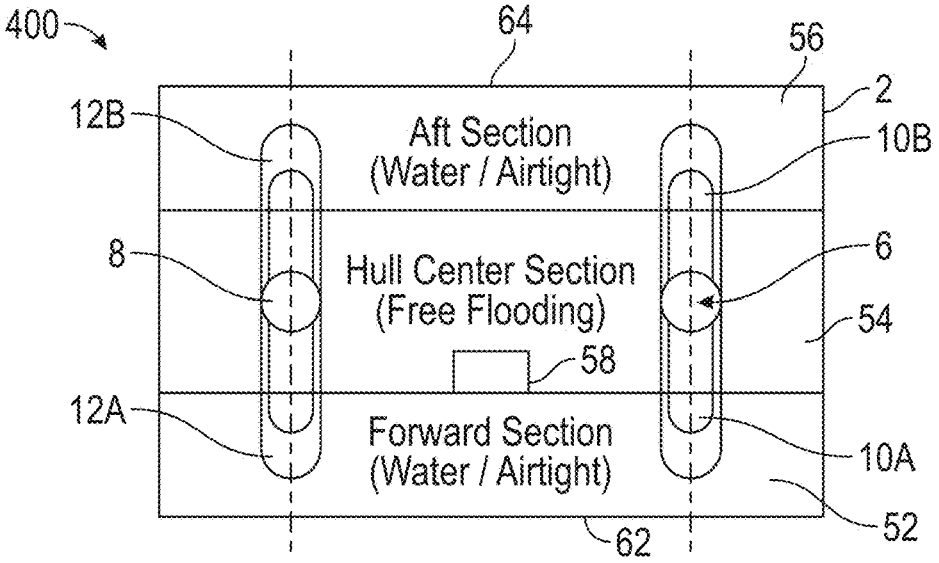
FIGS. 13A, 13B, and 13C are schematic plan, side elevation, and end elevation illustration views, respectively, of a wing tool suitable for use in systems and methods of the present disclosure in open water configuration.
Figure 13B:
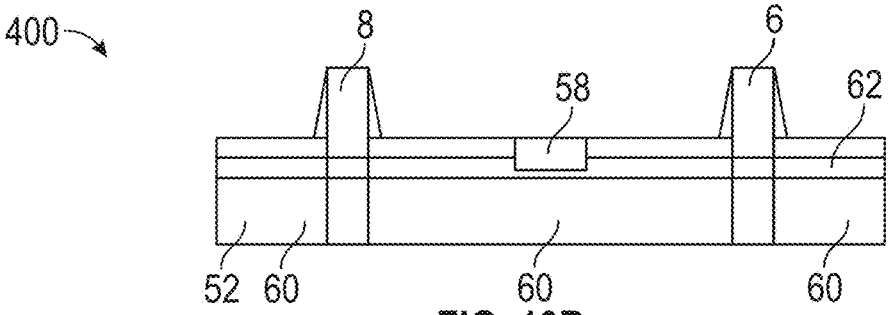
Figure 13C:
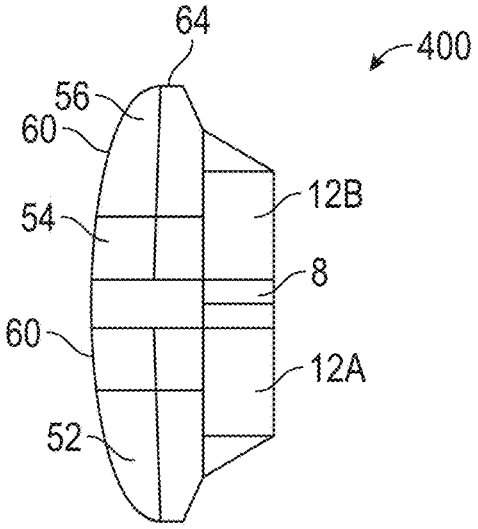

FIGS. 13A, 13B, and 13C are schematic plan, side elevation, and end elevation illustration views, respectively, of a wing tool embodiment 400 suitable for use in systems and methods of the present disclosure in open water configuration. Wing tool embodiment 400 includes a forward section 52, a hull center section 54, and an aft section 56. Both of the forward and aft sections 52, 56 are air-tight and water-tight compartments, while hull center section 54 is free-flooding. Hull center section 54 includes an instrument compartment 58 for scanning sonar, sonar altimeter, dual axis inclinometer, communication with the first vessel or other vessels, and possibly other instruments. The positions of port and starboard thrusters 6, 8, as well as port stabilizers 10A, 10B, and starboard thruster stabilizer 12A, 12B are illustrated. A curved bottom surface 60, as well as forward end 62 and aft end 64 of the wing tool produce the counter-balancing downward force (or downward component of force) necessary to maintain position when the thrusters are activated, as explained herein. Curved bottom surface 60 includes two openings or ports for the thrusters, as detailed in embodiment 600, FIGS. 15A, 15B.

Figure 14A:
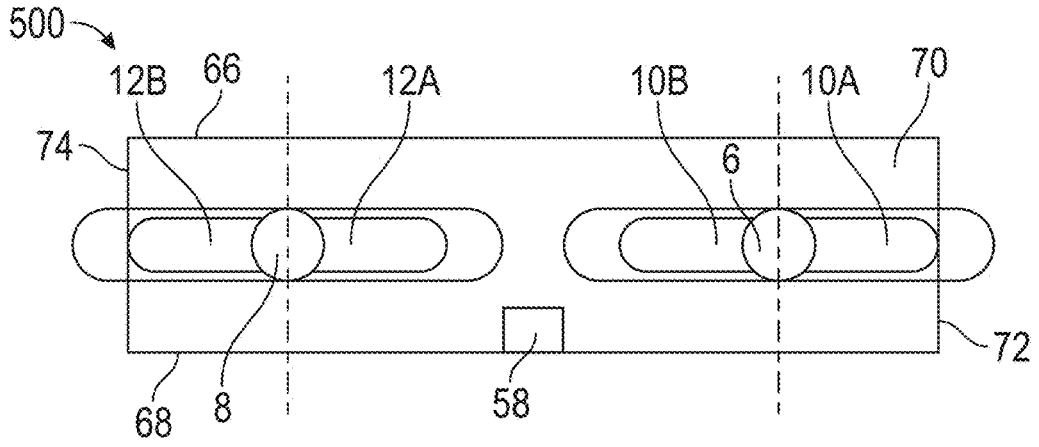
FIGS. 14A, 14B, and 14C are schematic plan, side elevation, and end elevation illustration views, respectively, of another wing tool suitable for use in systems and methods of the present disclosure in sheltered water configuration.
Figure 14B:
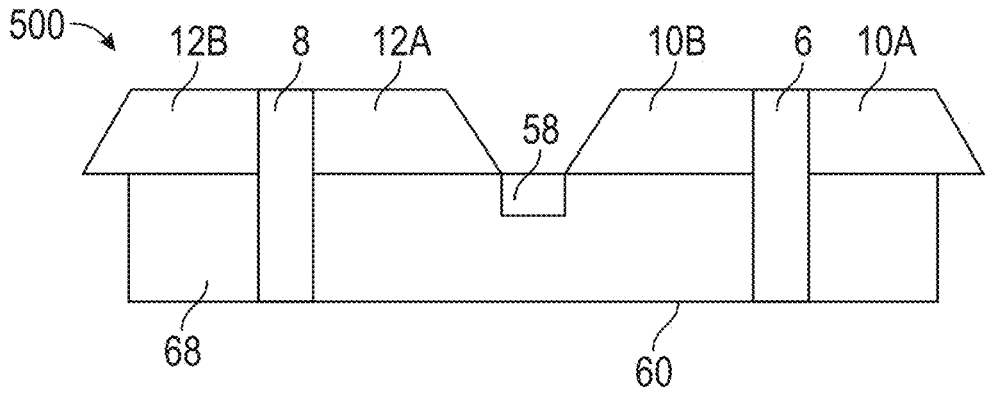
Figure 14C:
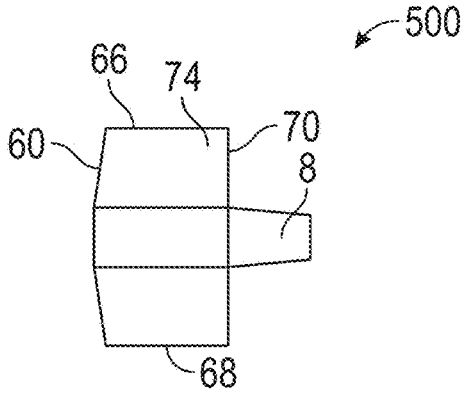

FIGS. 14A, 14B, and 14C are schematic plan, side elevation, and end elevation illustration views, respectively, of another wing tool embodiment 500 suitable for use in systems and methods of the present disclosure in sheltered water configuration. Wing tool embodiment 500 is devoid of forward and aft air- and water-tight sections, but includes first side plate or plates 66, second side plate or plates 68, top plate or plates 70, first end plate or plates 72, and second end plate or plates 74. If multiple metal plates are used they may be welded construction. Another difference from embodiment 400 is that in the sheltered water configuration of embodiment 500 thruster stabilizers 10A, 10B, 12A, and 12B are parallel to the long axis of the wing tool. Hull center section 54 includes an instrument compartment 58 for scanning sonar, sonar altimeter, dual axis inclinometer, communication with the first vessel or other vessels, and possibly other instruments.

Figure 15A:
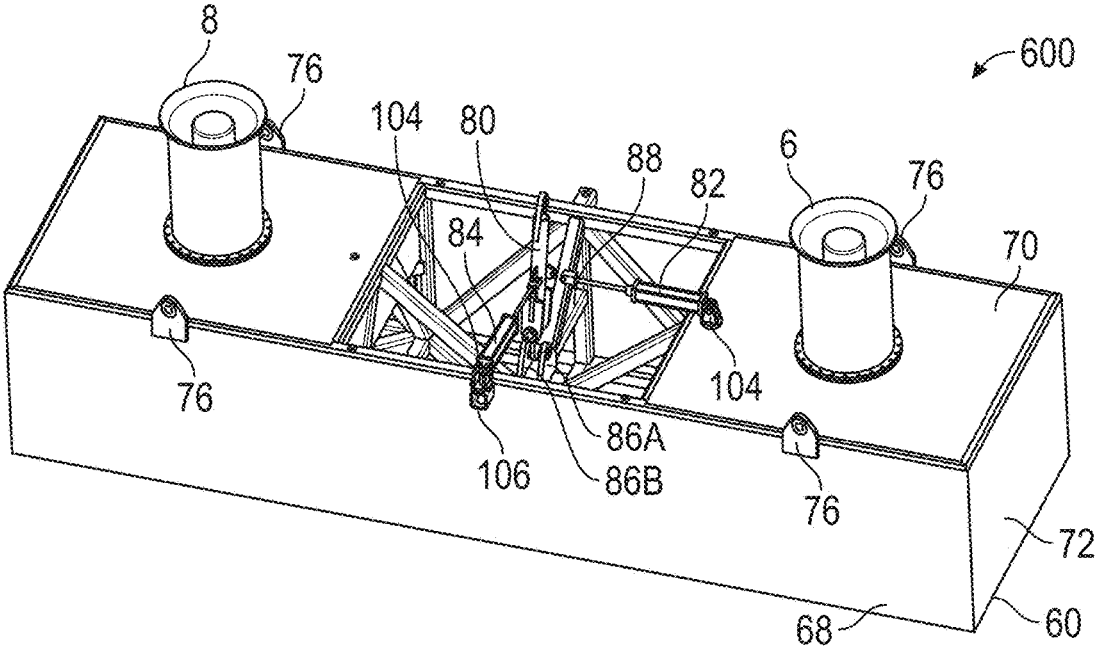
FIGS. 15A and 15B are schematic perspective and schematic perspective longitudinal cross-sectional views, respectively, of another wing tool suitable for use in systems and methods of the present disclosure in sheltered water configuration suitable for reservoirs, harbors and waterways.
Figure 15B:
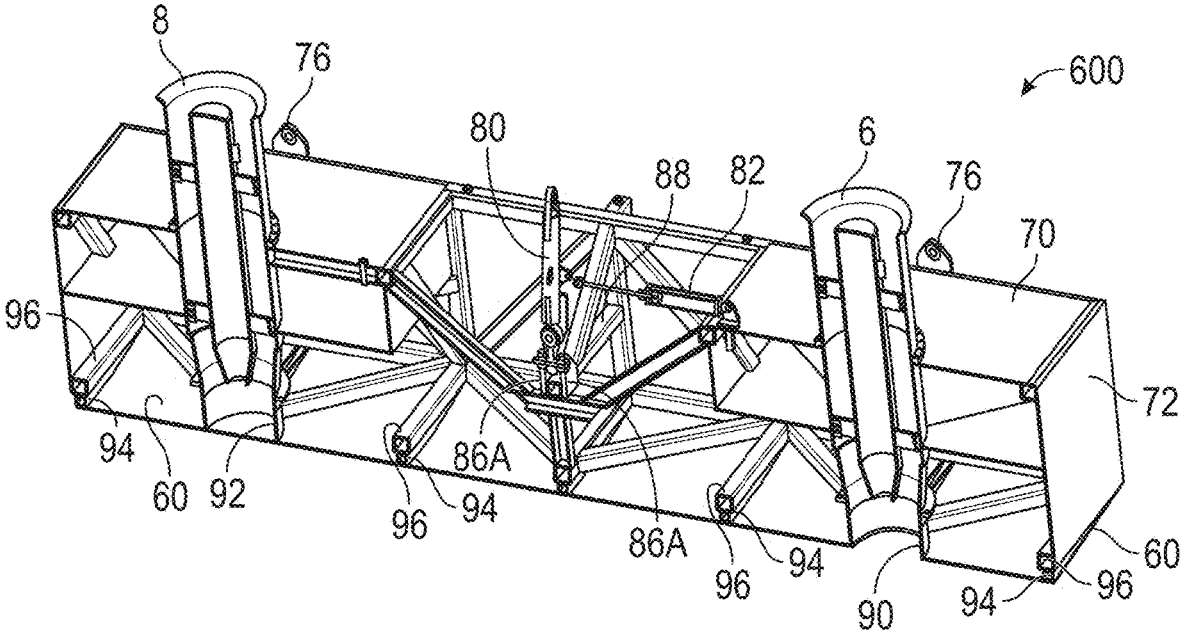
Figure 16A:
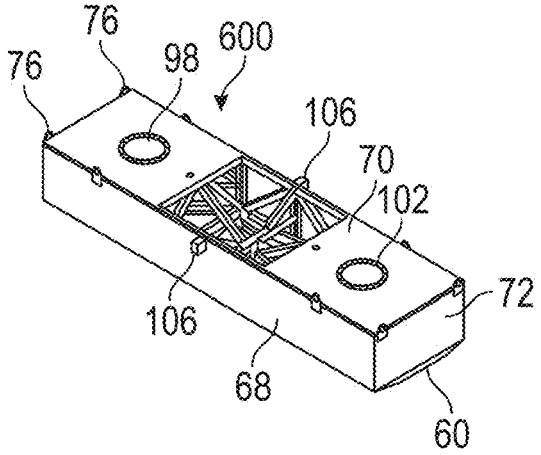
FIGS. 16A, 16B, 16C, 16D, and 16E are schematic perspective, top plan, side elevation, bottom plan, and end elevation views, respectively, of the wing tool of FIGS. 15A and 15B, with thrusters and thruster stabilizers removed.
Figure 16B:
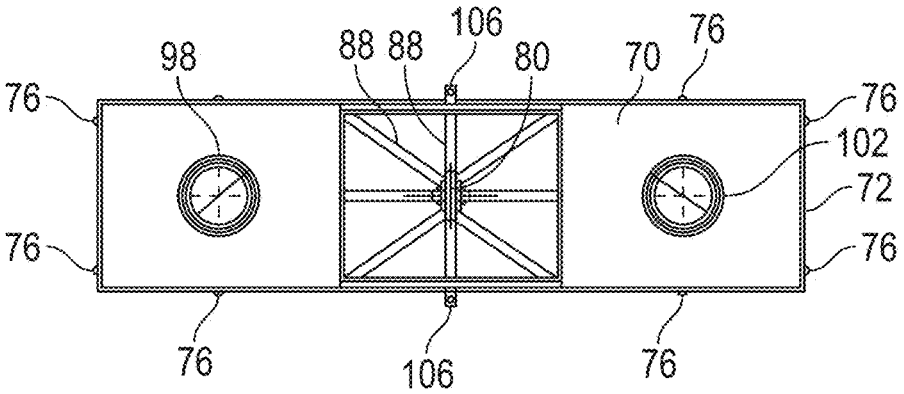
Figure 16C:
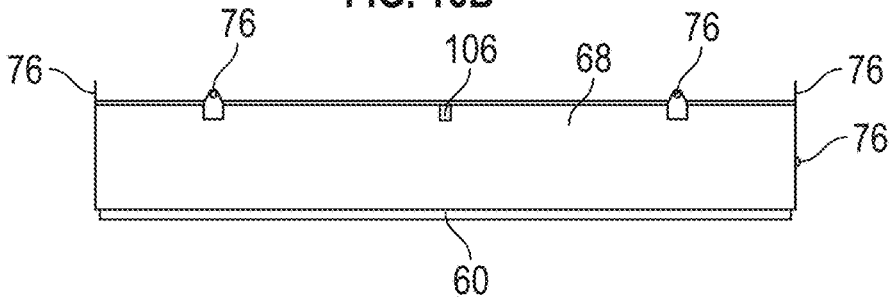
Figure 16D:
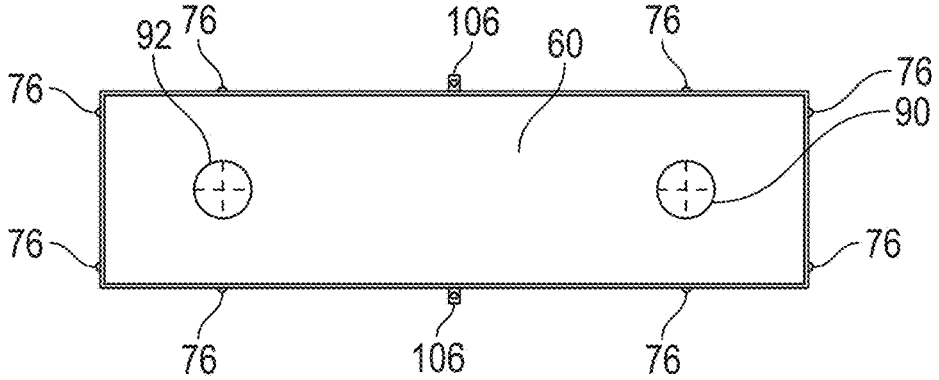
Figure 16E:
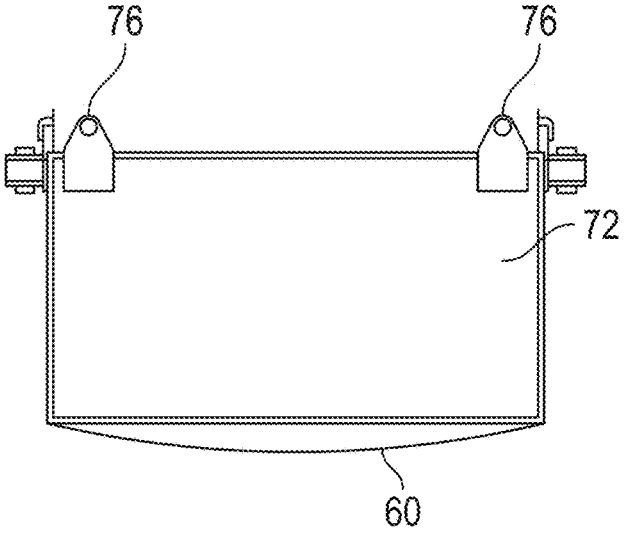

FIGS. 15A and 15B are schematic perspective and schematic perspective longitudinal cross-sectional views, respectively, of another wing tool embodiment 600 suitable for use in systems and methods of the present disclosure in sheltered water configuration. Wing tool embodiment 600 is similar to embodiment 500, but further includes four lifting eyes 76 welded to side plates 66, 68, and a gimbal connection 80 operated by hydraulic/electric cylinders 82, 84. A pair of central gimbal lifting eyes 86A, 86B secure gimbal connection 80 to a piece 88 of a framework of the wing tool. The framework comprises multiple tubular elements, typically steel, which may have rectangular, triangular, or circular cross-section, or combination thereof, arranged as illustrated in in FIGS. 15A-B, 16A-E, and 17A-E and welded to form the framework. Referring to FIG. 15B, curved bottom plate 60 has passages for thruster support outlets 90, 92. A set of curved ribs 94 are welded or otherwise secured on one side to framework elements 96 and the other side to curved bottom plate 60. Note there are several differences between embodiments 500 and 600 and the original wing tool described in European Pat. Nos. EP-A-0328198 and/or EP-0419484. There is only a single suspension cable connected to the center of gravity of the unit. Lateral stabilization may be created by cables back to the service vessel (as illustrated in FIG. 12). Control of pitch and roll attitudes of the wing tool in these embodiments is by mechanical or hydraulic actuators located at the enter section of the wing tool, and the structure is now composed of a frame over which is welded cover plates. Formerly known wing tools consisted of only cover plates welded together. The use of a frame and plate construction simplifies fabrication and reduces weight.

FIGS. 16A, 16B, 16C, 16D, and 16E are schematic perspective, top plan, side elevation, bottom plan, and end elevation views, respectively, of the wing tool embodiment 600 of FIGS. 15A and 15B, with thrusters and thruster stabilizers removed. Additional lifting eyes 76 are illustrated welded to end plates 72, 74. A pair of thruster connecting flanges 98, 102 are welded or otherwise secured to upper plate 70. Hydraulic/electric cylinder mounts 104 (FIG. 15A) are welded to supports 106 for same, which are in turn welded to the framework or to respective side plates 66, 68 and/or top plate 70.

Figure 17A:
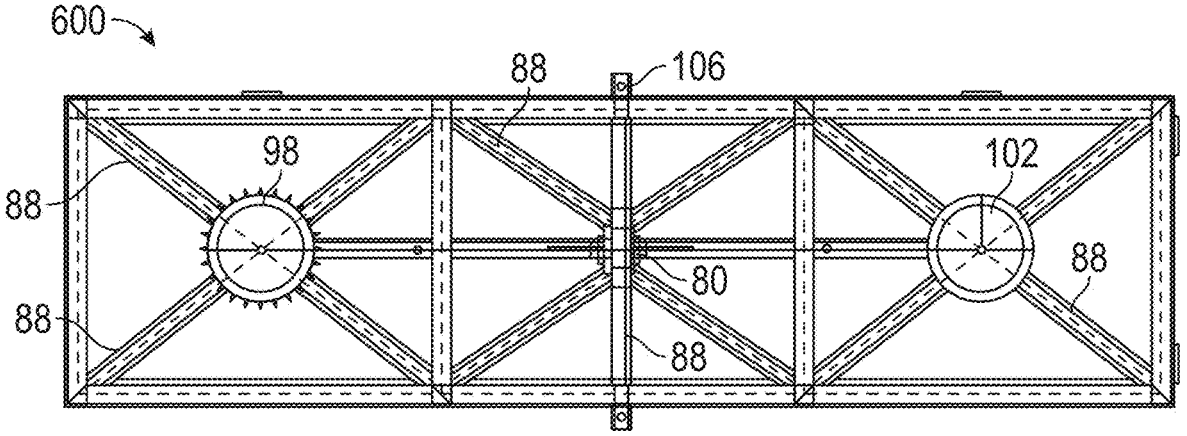
FIGS. 17A, 17B, 17C, 17D, and 17E are schematic top plan, end elevation, side elevation, transverse cross-sectional, and bottom plan views, respectively, of the wing tool of FIGS. 15A, 15B, 16A, 16B, 16C, 16D, and 16E with thrusters, thruster stabilizers, and structural plates removed.
Figure 17B:
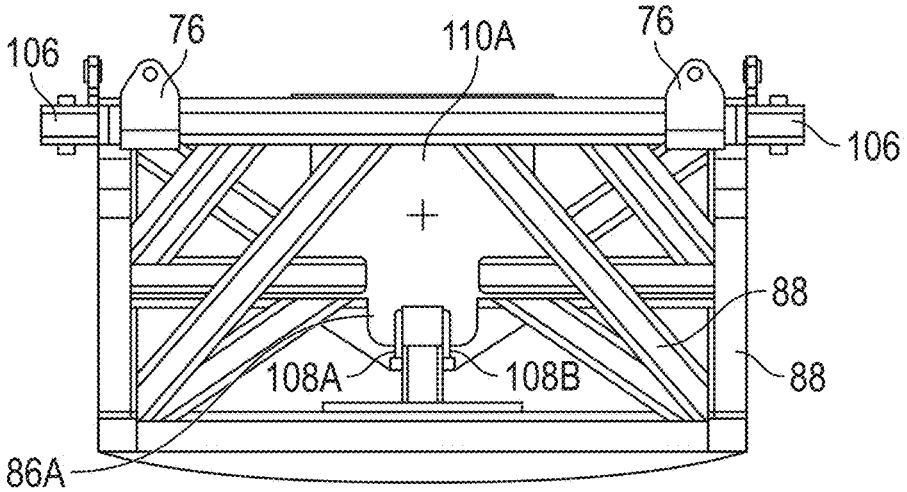
Figure 17C:
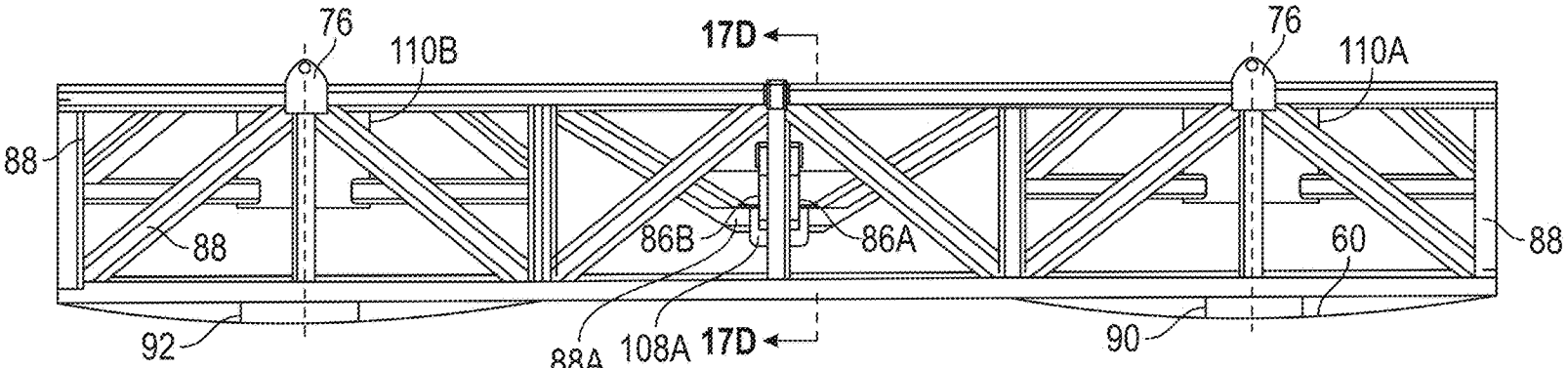
Figure 17D:
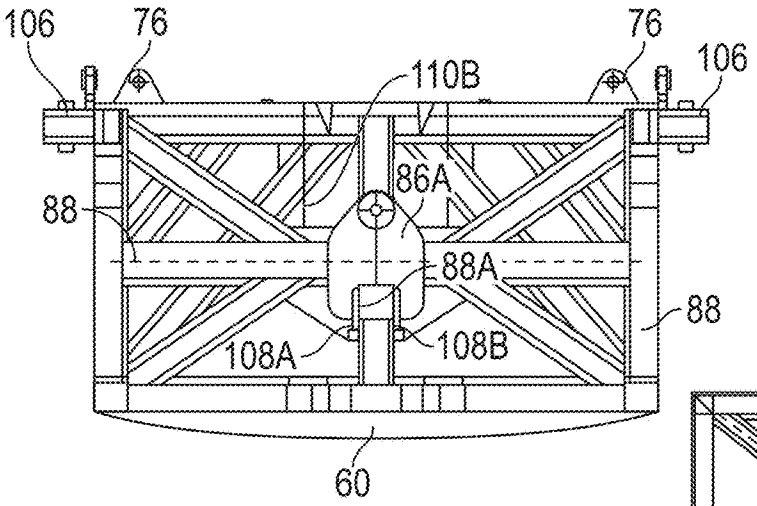
Figure 17E:
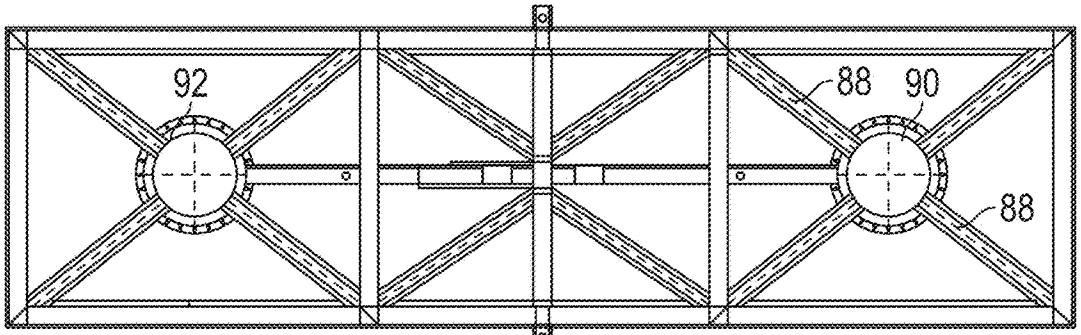
Figure 18:
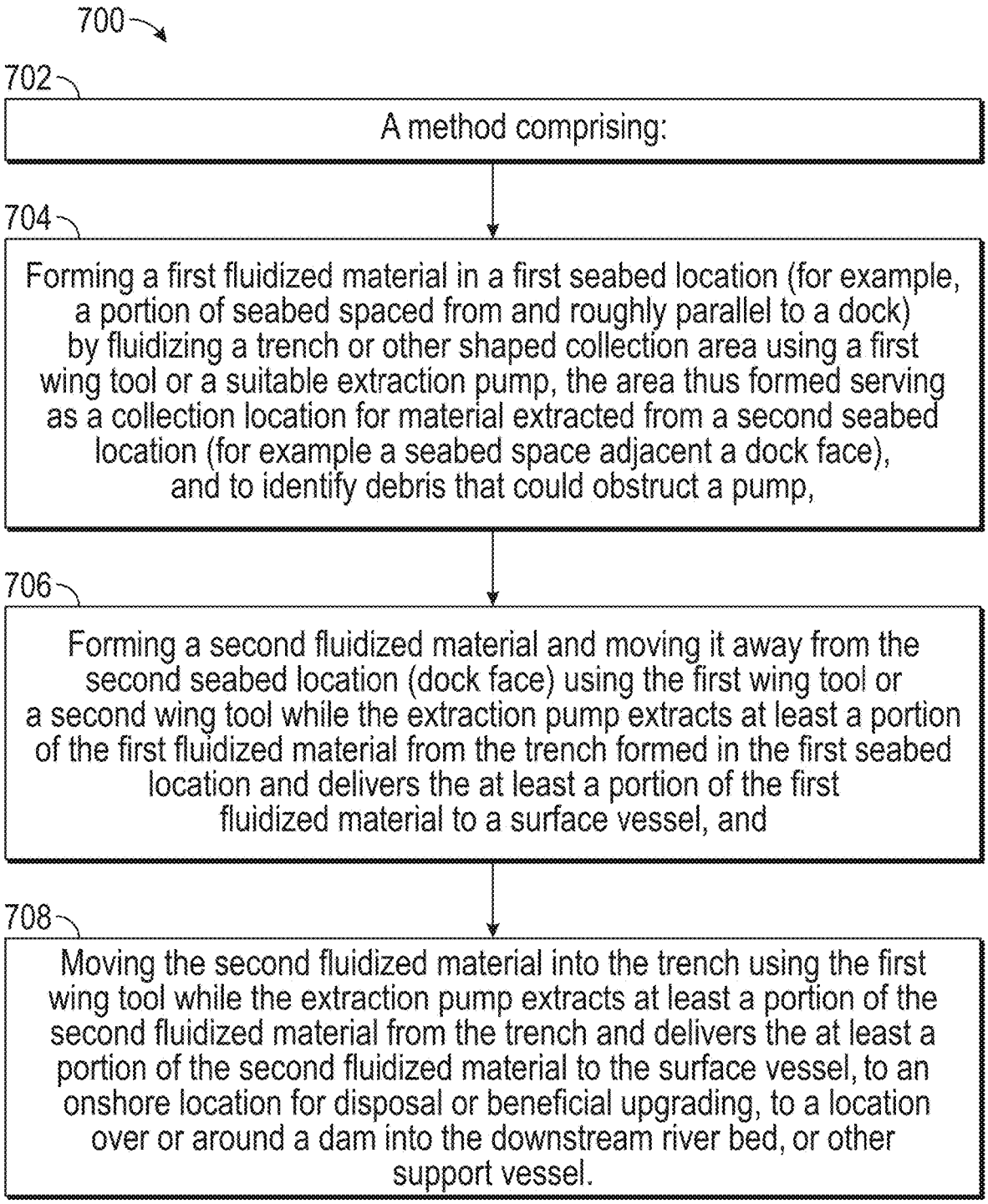
FIGS. 18-23 are logic diagrams of six methods in accordance with the present disclosure.
Figure 19:
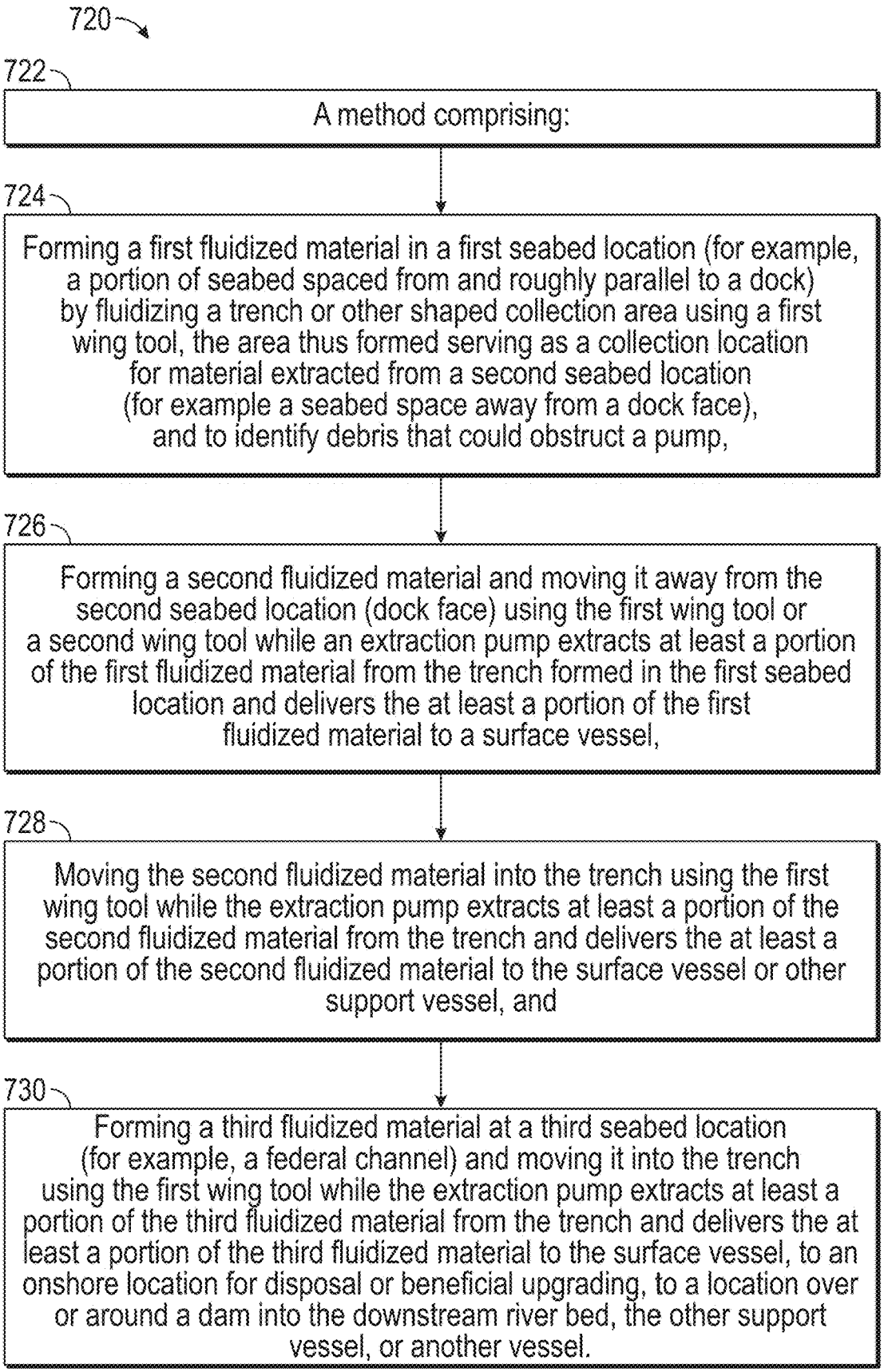
Figure 20:
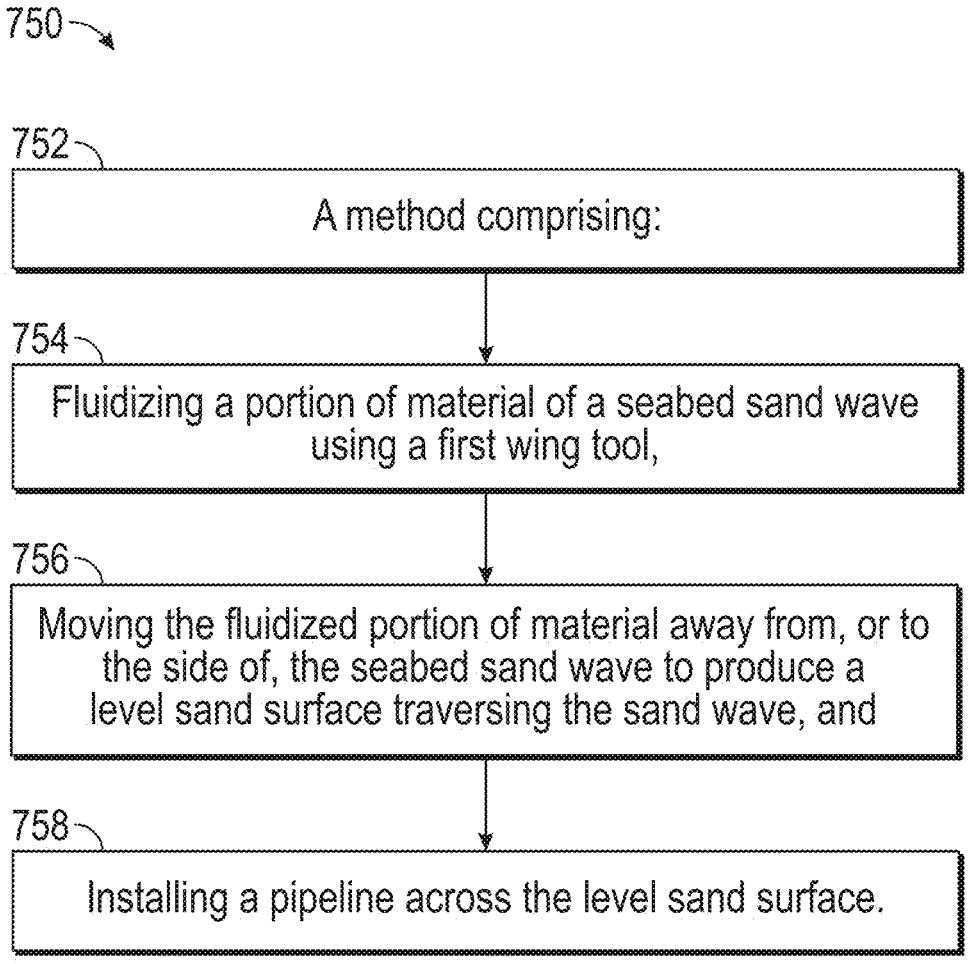
Figure 21:
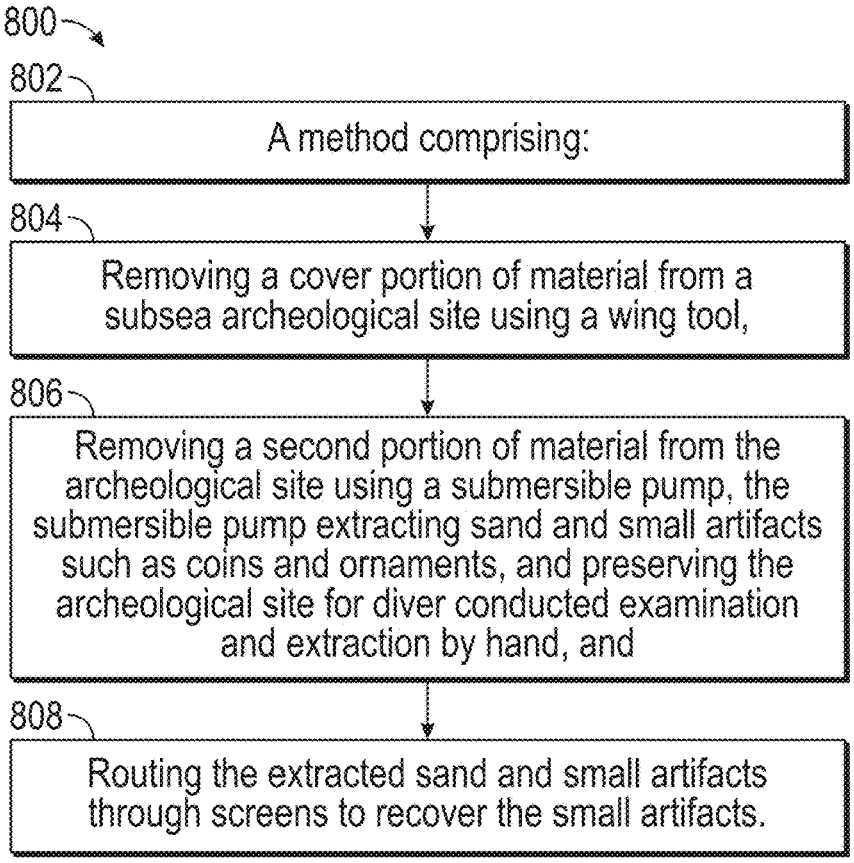
Figure 22:
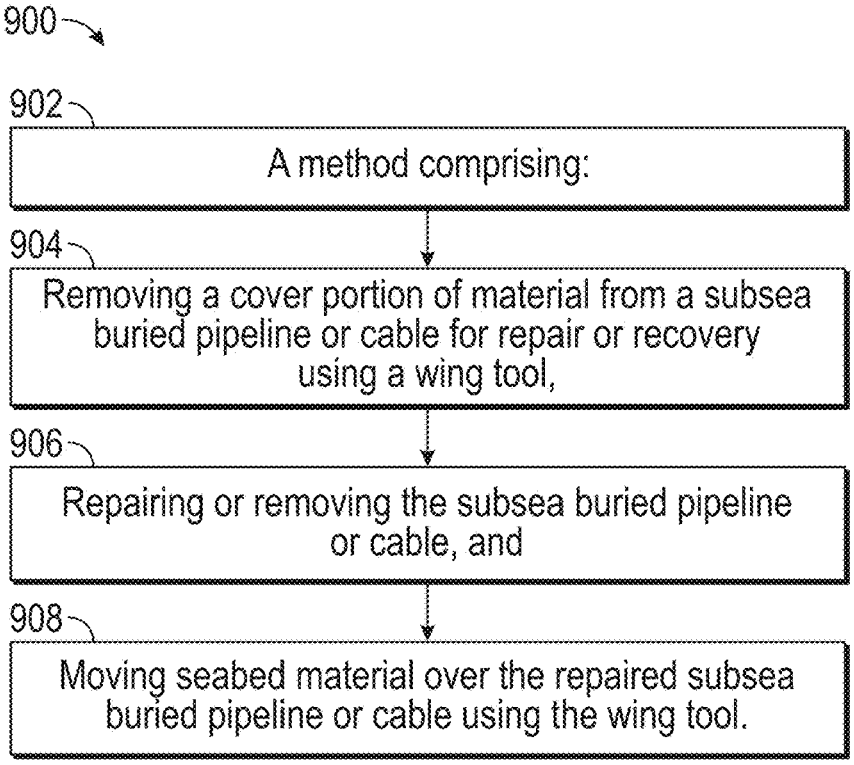
Figure 23:
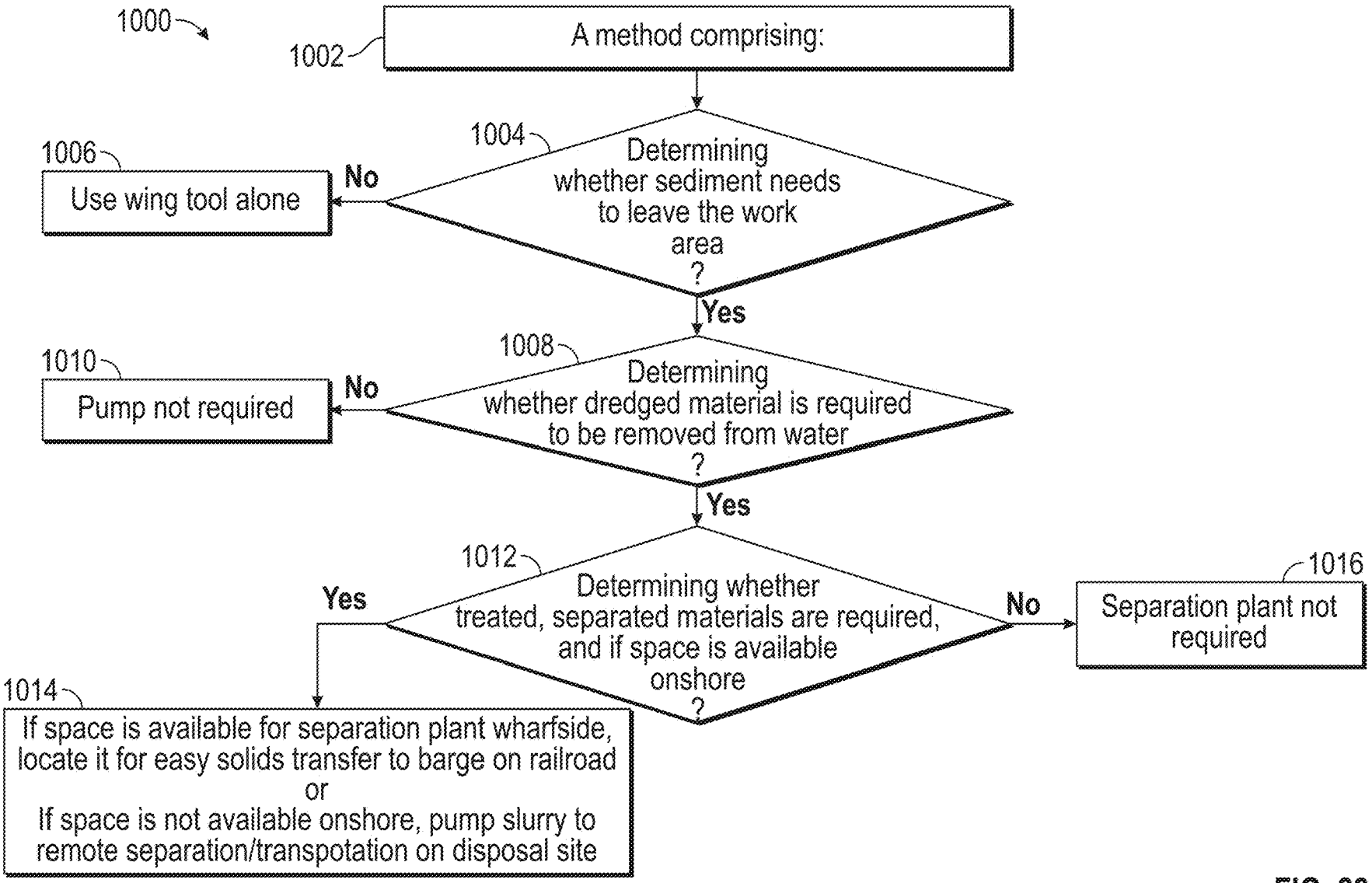

FIGS. 17A, 17B, 17C, 17D, and 17E are schematic top plan, end elevation, side elevation, transverse cross-sectional, and bottom plan views, respectively, of the wing tool embodiment 600 of FIGS. 15A, 15B, 16A, 16B, 16C, 16D, and 16E with thrusters, thruster stabilizers, and structural plates removed, so that the multiple framework tubular elements 88 may be viewed. As is most apparent from viewing FIGS. 17B-D, the pair of gimbal lifting eyes 86A, 86B have a notched lower end so that they fit to and may be welded to one of the framework tubulars 88A, and a pair of gimbal lifting eye supports 108A, 108B, which are simply plate pieces each having a pair of vertical notches, are welded to the tubular support element 88A (FIG. 17C) and to gimbal lifting eyes 86A, 86B. Also illustrated schematically in FIGS. 17B-D are a pair of upper thruster supports 110A, 110B, which are similarly welded to respective tubular elements 88 of the framework.

Certain systems and methods in accordance with the present disclosure comprise three pieces of operating equipment: 1) one or more wing tools, such as described in U.S. Pat. Nos. 6,125,560 and/or 6,374,519, and/or European Pat. Nos. EP-A-0328198 and/or EP-0419484; 2) one or more extraction pump(s) and work boat units, particularly systems and methods where local authorities or clients require removal of sediment from the water, this unit allowing sediment to be relocated either to a transportation barge (scow) for remote deposit or to a nearby deposit site; and 3) one or more separation plants (mobile or non-mobile, onshore or on a vessel) that may include one or more separation units to separate sand from fine grain materials (silts and clays) and entrained water, which may be required for projects that specify the need for beneficial use of the sediment.

EP-A-0328198 and EP-0419484 disclose one suitable wing tool and method of dredging a trench or other shape depression for sediment collection, concentration and extraction characterized by lowering a support member carrying one or more thrusters so that the thrusters are directed downwardly towards an area to be cleared, adjusting the orientation of the support member in the water so that it presents a surface relative to the thruster flow which causes a resultant downward vertical component of force, and operating the thrusters to direct a stream of turbulent water towards the area to be cleared, whereby the turbulence created sets the sand, silt and like material covering the area in suspension in the water as a dense mudflow so as to be carried away from the area by the flow of the water, the weight of the support member and the resultant downward force component in use being designed to provide a downward force in excess of the upward force caused by the thrusters. In certain embodiments, the support member is lowered from a vessel. Although it can be dynamically held in position by one or more thrusters or mounted on a trestle sitting on the sea or riverbed or on a floating pontoon, it will normally be set in its correct orientation by the adjustment of, for example, cables, chains or telescopic arms. The vessel may initially be stationed immediately downstream of the area to be cleared, where after the vessel is moved forward to cover the complete area at a controlled speed, this movement acting to increase the resultant downward force component on the support member. The support member can be designed to work in opposite directions, so that the vessel can then be turned and retraced over the area, after re-setting the orientation of the support member by adjustment of the cables. The '198 patent also discloses dredging apparatus for carrying out the methods comprising, a support member having one or more thrusters mounted thereon, orientation components to orient the support member to maintain the thrusters in a downward attitude, the support member providing a face against which the water flow can act to provide a stable and controllable downward component of force, the arrangement being such that in use, the weight of the support member together with the resultant force component produced provide a downward force which exceeds the upward force provided by the one or more thrusters. The orientation components to orient the support member preferably comprises cables or the like connected to the support member at at least three spaced points. The orientation components may be mounted to an associated vessel. Preferably, the support member is generally in the form of a wing comprising a casing (in certain embodiments having ballast tanks to adjust its weight, depending upon the working depth and the type of material to be cleared), the casing also having at least one closed bore passing between its upper and lower faces, in which the one or more thrusters is located. In some configurations, the casing is provided with an angled face at least along one (leading) edge thereof which, at least in part, causes the resultant downward force component in use; this component can be varied by appropriately tilting the casing so that its upper surface is angled to the horizontal. The one or more thrusters may comprise one or more propellers, each mounted within a closed bore, to rotate substantially parallel to the plane of the casing, in which case drivers for the propeller(s) are mounted on the casing and may be driven from an energy source on board the vessel by a cable, hose or the like. The energy source may be an electric generator and the driver electric motors. Alternatively, the source of energy may be a hydraulic pump on board the vessel and pressure fluid may be circulated through the drive unit via flexible hoses, the drive unit comprising a hydraulic motor including gearing which meshes suitably with gearing on the or each propeller shaft. The support member may be provided with transducers, and/or sonar, or like devices, directed downwardly so that, in use, electrical signals indicative of the working distance, and work progress can be transmitted to a suitable display on board the vessel.

Wing tool/vessel relationship—EP-A-0328198 and EP-0419484 focused only on the wing tool. The intent was to use a locally available supply boat as the platform from which to suspend and control the wing tool. However, we have now discovered that when pursuing markets in which road/rail mobility is essential, the ability to relocate the entire spread quickly and inexpensively are important considerations. That causes two philosophical changes (and associated hardware requirements for those embodiments where road/rail mobility is important): we designed a specially designed (there are no "local") vessel that can be broken into modules for transport to remote locations.

The modular vessel has three purposes: 1) to support the wing tool during tow in the water to the use site; the wing tool will be suspended in the water during tow to gain the lowest possible center of gravity for best vessel stability; this also keeps all lifting gear low to the water; 2) to position and maneuver itself to put the wing tool in the correct location and with the correct attitude to maximize the amount of sediment moved; and 3) to support total process efficiency by improving agility during maneuvers to minimize lost time during operations; although in most embodiments instructions come from the vessel (it is manned), instrumentation on the fluidizer will produce the information which allows the modular vessel to adjust itself to achieve optimum wing tool performance. As noted previously, the primary purpose of the vessel is to place the wing tool in the optimum location and at the best orientation to maximize sediment movement.

As noted previously, in certain embodiments the wing tool structure may be made more efficient, lighter and less expensive by incorporation of a structural framework that is plated on all sides (except the top of the center section to allow free motion of the gimbal, single point suspension). This is easier to build and so can be licensed to multiple fabricators. An all-plate design can still be considered an option. In addition to the four point suspension from the vessel originally contemplated, certain embodiments may eliminate the four point suspension in lieu of a single point suspension that, through hydraulic (or electrically driven screw turnbuckles mounted on the wing tool) can pitch and roll the wing tool during submerged operation from controls on the vessel.

A hydraulic or electric extraction pump transfers the dredged material from the collection point to either a hopper barge for transport to a deposit site (conventional dredging) or to separation plant from which beneficial disposal of the three streams is initiated, or through reservoir outlets or above/around dams. Suitable extraction pumps may be suspended from a second, independent, work boat to increase the efficiency of the dredged material removal operation and may move the collected materials to deposit areas more than 2,000 feet from the pump intake. If space is available on the wharf, trailers on which the separation and dewatering units may be located there, and if not, the extraction line may be connected to a boost pump to extend the distance between pump and separation plant to lengths limited only by pipeline access ways and project economics to, allowing the plant to be positioned in an area of lower activity, perhaps near a rail siding or at a location with easy access to hopper barges for efficient transportation of sand and dewatered fine grain materials to purchasers or to deposit sites. Suitable extraction pumps include, but are not limited to, those known under the trade designation EDDY PUMP available commercially from Eddy Pump Corporation, El Cajon, California. One set of suitable extraction pumps may be those listed in Table 1, available from Eddy Pump Corporation. Submersible pumps known under the trade designation EDDY PUMP may either be electrically or hydraulically driven and may include water jetting ring agitators. Unlike other dredge pumps, pumps known under the trade designation EDDY PUMP do not have an impeller, but instead have a heavy duty geometrically designed rotor that creates a synchronized eddy current similar to a tornado. Pumps known under the trade designation EDDY PUMP can be attached by cable and suspended from a crane, excavator, floating barge with a-frame or other devices for optimal solids pumping. High chrome versions of pumps known under the trade designation EDDY PUMP exhibit reduced clogging and erosion when compared with conventional pumps or having downtime associated with maintaining critical tolerances. The "cable deployed" versions can be fitted with pumps ranging in size from 4-inch through 12-inch discharge size pumps. Production measures at 100-450 cubic yards per hour of material, at distances over 2000-ft. The water jetting ring can be configured in ways to break up the most consolidated material while feeding pumps known under the trade designation EDDY PUMP. The Eddy Pump Corporation offers versions with instrumentation allowing view reach, depth, and GPS location, allowing precision dredging in real time by allowing an operator to track precisely where they are dredging at all times.

TABLE 1

Extraction Pumps Known Under the Trade Designation EDDY PUMP, Available from the Eddy Pump Corporation (cable deployed, with jetting ring, percentage solids ranging from 40-70 percent)

| Model | Max Flow | Suction Size | Discharge Size | Size of Solids Handled (up to | Cubic Yards of Material/Hr. | |
|---|---|---|---|---|---|---|
| JPH | (gpm) | (in.) | (in.) | inches) | From | To |
| 12000 | 7,000 | 14 | 12 | 11 | 500 | 600 |
| 10000 | 5,000 | 12 | 10 | 9 | 300 | 350 |
| 8000 | 4,000 | 10 | 8 | 7 | 250 | 300 |
| 6000 | 2,000 | 8 | 6 | 5 | 150 | 200 |
| 4000 | 1,200 | 6 | 4 | 3 | 75 | 150 |

Units (mobile or non-mobile) that separate sand from fine grain materials (silts and clays) and entrained water may be required for projects that specify the need for beneficial use of the sediment. Suitable mobile units include, but are not limited to, separation systems provided by TriFlo International, Willis, Texas, which are characterized by modular units, such as the model "Environmental System" ES 2000 which is designed to be mounted on a standard 50 foot trailer for road mobility. Certain units available from TriFlo International may be "containerized", meaning that they are designed to be transported within a 20 to 40 foot standard ISO certified containers and include mechanical separation technology including elliptical and linear shakers as well as ten, four, and/or two inch hydrocyclones. One separation unit that may be useful in systems and methods of the present disclosure is a two phase de-sanding unit, which optionally may include a removable equipment skid for non-routine maintenance. Another suitable separation unit may be a three phase cleaning unit (dewatering, desilting, and desanding), with an optional hopper that may be added for small batch mud treatment. A single phase de-silting unit may be another suitable separation unit. In certain embodiments, a de-sanding unit and a desilting unit may be operated in series for three phase cleaning. Flow rates through these units may range from about 120 to about 1000 gpm.

Features of systems and methods of the present disclosure include:

- traditional dredges are single purpose vessels; because material movement is separated from extraction, wing tools are better suited for many other tasks (summarized herein) that traditional dredges perform less well; thus the systems of the present disclosure add a great deal of flexibility to normal dredging operations;
- as both work vessels are compact and agile, they are suited for work in restricted areas such as vessel berths; they can work in close proximity to vessels and to harbor facilities without risk of damage; operations may be suspended with minimal loss to job momentum, allowing access to berths on short notice;
- as wing tools do not use cutters or teeth to move sediment, integrity of underwater pipelines and cables and other in-water structures such as docks, dolphins, anchor points, and known or unknown submerged artifacts are not threatened;
- wing tools operate using a fluidized sediment technique; as a result, only debris that can be moved with the fluidized sediment flows to the extraction point, reducing risk of debris damage to the extraction pump;
- the energy used by wing tools to fluidize the sediment creates a stable, horizontal, mud flow that is controllable, in some embodiments a cylindrical shape; tests have demonstrated that the mud flow does not significantly enter the water column, minimizing sediment entrainment and that the mud flow collapses as soon as the fluidization action from the wing is terminated;
- systems and methods of the present disclosure are suitable for operation in inland, coastal (such as the 3,000 mile Intracoastal Waterway in the United States) and offshore waters (offshore operation may require different support vessels and is used primarily for sediment movement and not extraction), and reservoirs (where mobility, operation at depths greater than 40 feet, and ability unclog lower outlets are of great value);
- water depth is not a constraint.

Wing material movers (wing tools) can also be used independently to perform other tasks such as:

- levelling sand waves in both sheltered and open waters;
- creating supports for unsupported pipeline spans;
- trenching for and replacing cover material over new marine pipelines; native sediment, imported sand or gravel (up to 2 inches in largest dimension) can be moved by wing tools to re-cover pipelines;
- uncovering operating marine pipelines and cables for inspection, repair or removal;
- removal of abandoned pipelines;
- removing sediment layers above marine archeological sites;
- maintaining canal locks and dams;
- sediment nourishment of intertidal zones, mudflats and marshes; and
- environmentally acceptable disposal of contaminated bottom materials.

Systems and methods of the present disclosure provide an integrated approach to dredging of reservoirs, inland waterways, and port facilities in an environmentally friendly manner. The application of innovative technology improves dredging efficiency and provides opportunities to improve marginally functioning port facilities at competitive costs. The systems of the present disclosure are designed to economically address projects where the volume of materials removed may range from about 5,000 to about 30,000 cubic yards, but can be used for larger projects (more than 30,000 cubic yards removal).

Systems and methods of the present disclosure have minimal environmental impact; provide for beneficial use of sediments (for example, beneficial disposal of dredged materials also eliminates dependence on use of limited United States Army Corps of Engineers (USACE) placement capacity); maximize berth availability by efficient removal of dredged materials and by agile marine equipment that can rapidly relocate to allow use of the berth; safe for use around wharves, docks, other waterfront structures and pipelines or cables (no blades or teeth); rapid mobilization and demobilization due to road transportable components; cost competitive with traditional dredging methods, allowing the flexibility to economically schedule smaller or emergency projects as required.

As mentioned previously, certain embodiments may include additional tools for locating, and possibly removing, underwater debris (like trees, cars, shopping trolleys and wire ropes) after it is exposed by blowing the covering sediment away. A good example would be grabbers to remove trees that clog up the outlets to reservoirs after sediment is blown away; this is currently performed by divers, which is very expensive and very unsafe. Accordingly, certain systems and methods for small reservoirs and reduced sediment quantities may include one or more of the following features:

- mobilize the critical elements of the system to the reservoir (probably the wing tool and the extraction pump);
- stockpile the specified quantity of sediment into a designated area (possibly against the heel of a dam);
- demobilize those key elements and move them to the next project;
- mobilize a separate, smaller pump spread to the reservoir with the pump size dictated by the maximum quantity of sediment permitted for release downstream per specified period;
- the small pump vessel may operate in a programmed robotic mode since the movements would be within the stockpile area only and at predetermined water depths and without any obstructions;
- construct a small permanent base and ramp capable of boat launch and recovery, storing and maintaining the pump and utility boats, and a small administration/warehouse building; also, install USGS sediment measurement facilities to monitor incoming and extracted sediment to provide the reservoir operators and environmental groups relevant data;
- retain the unit at the worksite on a year-round basis using local, specially trained personnel;
- contract for a longer-term period, during which the wing tool and associated extraction pump will return to the reservoir to renew the stockpile of sediment as required.

We believe that systems and methods of the present disclosure having one or more of these features for small reservoirs and reduced sediment quantities will have the following advantages: potential to avoid periodically defined complete system mobilizations; smaller and less expensive vessels for use during long-term maintenance; reduced marine personnel after vessel automation is approved; the personnel will be local and less costly than travelers; the operation will also support the local economy; keeping local workers employed year-round will be only marginally more expensive than hiring temporary employees and training them yearly; another task of the site group would be to maintain the USGS sediment measurement instruments annually; in the long term, permanent facilities will be less expensive than yearly erection and temporary facilities removal.

Operation of Systems of the Disclosure

As noted herein, systems of this disclosure may comprise three major elements:

The wing tool, which functions as a levelling/trenching tool, is suspended from a dedicated work vessel. The wing tool fluidizes the dredged material in swaths up to 20 feet wide and moves it to a predefined material collection location. When material removal is required, a large hollow, trench, or depression is created in the bottom sediment before dredging starts. That depression acts as a natural collector for the fluidized sediment as well as a "sump" in which heavier sediments concentrate for removal of a more consistently dense suspension of sand and fine grain materials. Greater density increases the efficiency of both the marine excavator pump and the downstream separation plant. The dredged material is fluidized and relocated by one or more, in some instances two downward pointing, variable thrust, ducted, counter-rotating, impellers. The action of these thrusters forms a dense wave, or density current, at the sediment-water interface. The heading of the wing, relative to the heading of the vessel, determines the width of the sediment path fluidized (from a pipeline trench to a full 20 foot swath). The angle of the thrusters relative to the bottom determines the direction of the lateral force imparted to the fluidized sediment. This amount of force applied to the sediment is adjusted by the distance between the wing and the bottom and by the speed of the thrusters. It is safe to use the wing around buried facilities such as pipelines and cables and it can work in close proximity to waterfront facilities such as wharf faces.

A hydraulic or electric extraction pump transfers the dredged material from the collection point to either a hopper barge for transport to a deposit site (conventional dredging) or to separation plant having one or more separation units from which beneficial disposal of the three streams or phases (sand, silt, and water) is initiated. The pump is suspended from a second, independent, work vessel to increase the efficiency of the dredged material removal operation. The pump can move the collected material more than 2000 feet from the pump intake and further if a booster pump is inserted in the discharge line. If space is available on adjacent land, the trailers on which the separation and dewatering units are mounted may be located there, if not, a booster pump may be inserted in the discharge to extend the distance between pump and separation plant allowing the plant to be positioned in an area of lower activity, for example, near a rail siding or at a location with easy access to hopper barges for efficient transportation of sand and dewatered fine grain materials to purchasers or to deposit sites.

The separation unit (sometimes referred to herein as a separation plant comprising one or more separation units) may comprise several sub-units:

- screens to remove large gravel and small debris from the incoming dredged material stream;
- sand dewatering and separation through one or more first separators, for example, but not limited to one or more hydrocyclone separators, centrifuges, or the like to produce a predominantly sand stream and a predominantly water stream;
- optionally, one or more second separators, for example, but not limited to, one or more hydrocyclones, centrifuges, filters and the like to further remove sand and some fine grain materials from the predominantly water stream, and produce a second predominantly water stream suitable for discharge to surface water bodies in accordance with applicable permits;
- optionally, one or more injection pumps for injecting chemicals, for example, flocculent, into the second predominantly water stream to accelerate settling out of the remaining fine grain materials to form a fine grain sludge and a processed water stream;
- one or more sub-units for dewatering (such as a filter press) the fine grain sludge to create a product that is suitable for use as a raw material for other processes or acceptable to local landfill deposit sites;
- one or more auxiliary pumps for pumping the processed water for redeposit into the dredged area.

During the separation processes, clean sand may be piled near the plant for removal by truck, rail or hopper barge and the dewatered (and dried) fine grained materials cake may be accumulated separately for removal also by truck, rail or hopper barge. These substances may be handled according to pre-dredge permit conditions.

Environmental Impact of Moving Marine Sediment

Two questions are frequently asked:

Will fluidized material enter the water column for wide dispersion by local currents? No, the wing tool fluidizes the sediment, forming a dense wave at the sediment-water interface. It has been demonstrated that the wave does not re-entrain sediment into the water column. This phenomenon has been verified by Acoustic-Doppler Current Profiler studies and by dissolved solids sampling and analysis around and above the sediment wave and adjacent to an operating wing tool.

Will sediment at the sediment-water interface migrate in an uncontrolled manner? No. There has been concern that dredged material will migrate into a federal channel or other undesired channel. As the wing tool imparts a directional flow to the sediment, the wave remains cohesive and moves across the bottom in a rolling cylinder of from approximately 1 to 3 feet in diameter. The resulting transport distance depends on: the lateral force imparted by the wing tool, the action of the local currents, the density and composition of the sediments, and the slope and smoothness of the water-bed. The sediment will tend to flow into depressions in the water-bed, but only those depressions in the direction imparted by the wing tool, and will cease flowing due to friction forces and gravity when the wing thrusters are stopped.

Other Uses of Systems of the Disclosure

In addition to precision dredging of port facilities, systems in accordance with the present disclosure may also be used for:

- levelling sand waves in both sheltered and open waters;
- trenching for and replacing cover over newly installed marine pipelines;
- uncovering existing marine pipelines and cables for repair or removal;
- removal of abandoned pipelines;
- maintaining canal locks and dams;
- removing sediment layers above marine archeological sites;
- sediment nourishing of intertidal zones, mudflats and marshes;
- environmentally acceptable disposal of contaminated bottom materials.

One or more sensor(s) may be mounted onto and/or into the wing tool through a variety of ways depending on the sensor being installed, openings available in the wing tool, and the level of accuracy required. Software either intrinsic to the sensor or installed remotely on a computer type device, may convert the measurements into usable calculated information. The usable calculated information may be displayed locally at the device and/or remotely on a computer type device.

Sensors installed on the wing tool or work vessel may, in certain embodiments, be powered from within an instrument display or other human/machine interface (HMI) itself, for example using batteries, Li-ion or other type. In other embodiments the display/HMI may be powered from an instrument cable providing power to the sensor, perhaps by a local generator, or grid power. A display/HMI on a work vessel allows an operator to interface with the sensor. In certain embodiments the operator will be able to take measurements, view or read these measurements and reset the instrument for subsequent measurement taking. If the display/HMI is connected to a power cable, then measurements may be taken remotely, stored and reset as necessary. In addition to instrument-assisted operation, certain systems of the present disclosure may be fully instrument-controlled operation in situations where safety is not compromised in the event of surprises in the sediment or by equipment malfunction.

In certain embodiments, a movable Time-of-Flight (TOF) or LIDAR scanner may be installed on the wing tool, such as disclosed in U.S. Pat. No. 9,223,025, which discloses systems and methods for conducting autonomous underwater inspections of subsea and other underwater structures using a 3D laser mounted on an underwater platform such as AUV, an ROV or a tripod. The systems and methods described in the '025 patent can be used for scanning underwater structures to gain a better understanding of the underwater structures, such as for example, for the purpose of avoiding collision of a wing tool with the underwater structures and for directing inspection, repair, and manipulation of the underwater structures. Newton Labs (Renton, Washington) offers underwater scanners featuring sophisticated, Newton-developed software working in concert with a laser scanner and a high-resolution video camera. The software compensates for refraction, turbidity and suspended particles, resulting in the generation of a dense point cloud of the scanned area that, when processed by industry standard 3-D software, results in a fully measurable CAD file. All Newton underwater scanner models operate by laser triangulation. The projected laser line sweeps the target surface and the high resolution camera captures and records any deformation of the line as a point cloud enabling ultimate 3-D computation. Scanners are designed to scan and capture much larger target areas, by combining several point clouds together to form larger composites. Laser light color is maximized for water penetration. The specific wavelength of the laser allows for highest possible efficiency underwater transmission. The scanner camera only accepts the specific color produced by its own laser and LED lights, greatly reducing any contamination from stray light in the scanning environment. Useful underwater scanners include those known by model numbers M210UW and M310UW. In certain embodiments, the scanner does not require an external mechanism within the housing to make it sweep through the require angle. The M series scanners have an internal ability to sweep through the required path via a "push button" on a control consol.

The wing tools and any underwater sensors, housings, and couplings are all made of material capable of withstanding prolonged exposure to the underwater environment in which they are used. In certain embodiments power would be supplied to the sensor(s) at a voltage and current that enables the device to be intrinsically safe. By "intrinsically safe" is meant the definition of intrinsic safety used in the relevant IEC apparatus standard IEC 60079-11, defined as a type of protection based on the restriction of electrical energy within apparatus and of interconnecting wiring exposed to the potentially explosive atmosphere to a level below that which can cause ignition by either sparking or heating effects. For more discussion, see "AN9003—A User's Guide to Intrinsic Safety", retrieved from the Internet Jul. 12, 2017, and incorporated herein by reference.

Certain embodiments may employ a 3D time of flight sensor. Such sensors may be exemplified by those described by Texas Instruments. 3D time of flight products, tools and development kits enable machine vision with a real-time 3D imaging depth camera. From robotic navigation to gesture recognition and building automation, TI's 3D time of flight chipsets allow for maximum flexibility to customize a camera's design. 3D time of flight operates by illuminating an area with modulated IR light. By measuring the phase change of the reflected signal the distance can be accurately determined for every pixel in the sensor creating a 3D depth map of the subject or scene.

One suitable TOF sensor is the sensor known under the trade designation "OPT8241 time-of-flight (TOF) sensor" available from Texas Instruments (TI). The device combines TOF sensing with an optimally-designed analog-to-digital converter (ADC) and a programmable timing generator (TG). The device offers quarter video graphics array (QVGA 320×240) resolution data at frame rates up to 150 frames per second (600 readouts per second). The built-in TG controls the reset, modulation, readout, and digitization sequence. The programmability of the TG offers flexibility to optimize for various depth-sensing performance metrics (such as power, motion robustness, signal-to-noise ratio, and ambient cancellation). Features of the TOF sensor known under the trade designation "OPT8241 time-of-flight (TOF) sensor" available from Texas Instruments (TI) are provided in Table 2.

TABLE 2

"OPT8241 time-of-flight (TOF) sensor" available from Texas Instruments (TI)

- Imaging Array:
  - 320 × 240 Array
  - 1/3" Optical Format
  - Pixel Pitch: 15 μm
  - Up to 150 Frames per Second
- Optical Properties:
  - Responsivity: 0.35 A/W at 850 nm
  - Demodulation Contrast: 45% at 50 MHz
  - Demodulation Frequency: 10 MHz to 100 MHz
- Output Data Format:
  - 12-Bit Phase Correlation Data
  - 4-Bit Common-Mode (Ambient)
- Chipset Interface:
  - Compatible with TI's Time-of-Flight Controller OPT9221
- Sensor Output Interface:
  - CMOS Data Interface (50-MHz DDR, 16-Lane Data, Clock and Frame Markers)
  - LVDS:
    - 600 Mbps, 3 Data Pairs
    - 1-LVDS Bit Clock Pair, 1-LVDS Sample Clock Pair
- Timing Generator (TG):
  - Addressing Engine with Programmable Region of Interest (ROI)
  - Modulation Control
  - De-Aliasing
  - Master, Slave Sync Operation
- $I^2C$ Slave Interface for Control
- Power Supply:
  - 3.3-V I/O, Analog
  - 1.8-V Analog, Digital, I/O
  - 1.5-V Demodulation (Typical)
- Optimized Optical Package (COG-78):
  - 8.757 mm × 7.859 mm × 0.7 mm
  - Integrated Optical Band-Pass Filter (830 nm to 867 nm)
  - Optical Fiducials for Easy Alignment
- Operating Temperature: 0° C. to 70° C.

In certain systems and methods of this disclosure, the separation unit(s) may include filter media. Efficiency of separation in the separation unit, if it includes filter media, may be characterized by turbidity and silt density index (SDI) of the final processed water stream. SDI is a measurement of the fouling potential of suspended solids and may be determined by test method ASTM D4189-07(2014). Acceptable values depend on the filter media and even the filter media manufacturer of the "same" media, as well as temperature of the water being tested. Turbidity is a measurement of the amount of suspended solids. SDI and turbidity are not the same and there is no direct correlation between the two. According to the Water Treatment Guide, a publication of Applied Membranes, Inc., in practical terms, however, many filter media show very little fouling when the feed water has a turbidity of less than 1 NTU. Correspondingly these filter media show very low fouling at a feed SDI of less than 5. SDI may be reduced by injecting a coagulant that is compatible with the filter media, before the media filter. A dispersant may keep particles from fouling the media.

A wide variety of probes are available to measure turbidity—the degree to which light is scattered by particles suspended in a liquid. The measured turbidity, however, depends on the wavelength of light and the angle at which the detector is positioned. In certain embodiments, turbidity values of processed water from a hydrocyclone, or the effluent (filtrate) from a filter material, may range from about 0.0005 to about 800 NTU, or from about 0.0010 to about 700 NTU, or from about 0.0020 to about 650 NTU, or from about 0.0050 to about 600 NTU, or from about 0.01 to about 500 NTU. "NTU" refers to "Nephelometric Turbidity Unit" (NTU) and employs a sensor that measures scattered light at 90 degrees from an incident white light beam, according to EPA method 180.1.

FIGS. 18, 19, 20, 21, 22, and 23 are logic diagrams of six non-limiting method embodiments 700, 720, 750, 800, 900, and 1000 within the present disclosure. Method embodiment 700 (FIG. 18) comprises a method (box 702) comprising forming a first fluidized material in a first seabed location (for example, a portion of seabed spaced from and roughly parallel to a dock) by fluidizing a trench or other shaped collection area using a first wing tool or a suitable extraction pump, the area thus formed serving as a collection location for material extracted from a second seabed location (for example a seabed space adjacent a dock face), and to identify debris that could obstruct a pump (box 704); forming a second fluidized material and moving it away from the second seabed location (dock face) using the first wing tool or a second wing tool while the pump extracts at least a portion of the first fluidized material from the trench formed in the first seabed location and delivers the at least a portion of the first fluidized material to a surface vessel (box 706), and moving the second fluidized material into the trench using the first wing tool while the pump extracts at least a portion of the second fluidized material from the trench and delivers the at least a portion of the second fluidized material to the surface vessel, to an onshore location for disposal or beneficial upgrading, to a location over or around a dam into the downstream river bed, or other support vessel (box 708).

Method embodiment 720 (FIG. 19) comprises a method (box 722) comprising forming a first fluidized material in a first seabed location (for example, a portion of seabed spaced from and roughly parallel to a dock) by fluidizing a trench or other shaped collection area using a first wing tool, the area thus formed serving as a collection location for material extracted from a second seabed location (for example a seabed space away from a dock face), and to identify debris that could obstruct a pump (box 724); forming a second fluidized material and moving it away from the second seabed location (dock face) using the first wing tool or a second wing tool while the pump extracts at least a portion of the first fluidized material from the trench formed in the first seabed location and delivers the at least a portion of the first fluidized material to a surface vessel (box 726); moving the second fluidized material into the trench using the first wing tool while the pump extracts at least a portion of the second fluidized material from the trench and delivers the at least a portion of the second fluidized material to the surface vessel or other support vessel (box 728), and forming a third fluidized material at a third seabed location (for example, a federal channel) and moving it into the trench using the first wing tool while the pump extracts at least a portion of the third fluidized material from the trench and delivers the at least a portion of the third fluidized material to the surface vessel, to an onshore location for disposal or beneficial upgrading, to a location over or around a dam into the downstream river bed, or the other support vessel, or another vessel (box 730).

Method embodiment 750 (FIG. 20) comprises a method (box 752) comprising fluidizing a portion of material of a seabed sand wave using a first wing tool (box 754), moving the fluidized portion of material away from, or to the side of, the seabed sand wave to produce a level sand surface traversing the sand wave (box 756), and installing a pipeline across the level sand surface (box 758).

Method embodiment 800 (FIG. 21) comprises a method (box 802) comprising removing a cover portion of material from a subsea archeological site using a wing tool (box 804); removing a second portion of material from the archeological site using a submersible pump, the submersible pump extracting sand and small artifacts such as coins and ornaments, and preserving the archeological site for diver conducted examination and extraction by hand (box 806); and routing the extracted sand and small artifacts through screens to recover the small artifacts (box 808).

Method embodiment 900 (FIG. 22) comprises a method (box 902) comprising removing a cover portion of material from a subsea buried pipeline or cable for repair or recovery using a wing tool (box 904); repairing or removing the subsea buried pipeline or cable (box 906), and moving seabed material over the repaired subsea buried pipeline or cable using the wing tool (box 908).

Method embodiment 1000 (FIG. 23) comprises a method (box 1002) comprising determining whether material is required to be moved within bottom area (box 1004); if yes, then use wing tool alone (box 1006); if no, determining whether dredged material is required to be removed from water (box 1008); if no, pump not required (box 1010); if yes, determining whether treated, separated materials are required, and if space is available onshore (box 1012); if yes, space is available for plant onshore, locate near railroad siding or wharfside for pumping directly into barges (box 1014); and if no space is available onshore, pump materials directly to an onshore deposit site or into hopper barges (box 1016).

It will be understood that the wing tools need not have the shapes as illustrated in the drawings, but rather could take any shape, such as a box or cube shape, elliptical, triangular, pyramidal (for example, three or four sided), prism-shaped, hemispherical or semi-hemispherical-shaped (dome-shaped), or combination thereof and the like, as long as the wing tool is able to be maneuvered as desired. In certain embodiments, the dredger is wing-shaped, but this arrangement is not strictly necessary in all embodiments. For example, one or more corners, surfaces, or other features of the dredger could be arcuate or non-arcuate in shape. Examples of non-wing-shaped dredgers include those known under the trade designation RS1-LD JET TRENCHER commercial available from Rotech Subsea, Aberdeen, United Kingdom, or those available from James Fisher & Sons plc, Cumbria, United Kingdom. It will be understood that such embodiments are part of this disclosure and deemed within the claims. Furthermore, the one or more work vessels may be single-hulled, multi-hulled, submersible, semi-submersible, and the like, and the wing tool and vessels may be ornamented with various ornamentation produced in various ways (for example stamping or engraving, or raised features such as reflectors, reflective tape, patterns of threaded round-head screws or bolts screwed into holes in the collar or collision bumpers), such as oil rig designs, oil tool designs, logos, letters, words, nicknames (for example WING MARINE, and the like). Hand holds may be machined or formed to have easy-to-grasp features for fingers, or may have rubber grips shaped and adorned with ornamental features, such as raised knobby gripper patterns.

From the foregoing detailed description of specific embodiments, it should be apparent that patentable systems, combinations, and methods have been described. Although specific embodiments of the disclosure have been described herein in some detail, this has been done solely for the purposes of describing various features and aspects of the systems and methods and is not intended to be limiting with respect to their scope. It is contemplated that various substitutions, alterations, and/or modifications, including but not limited to those implementation variations which may have been suggested herein, may be made to the described embodiments without departing from the scope of the appended claims. For example, one modification would be to use multiple wing tools, one remotely controlled, and the others controlled by umbilicals. Another modification would be for wing tool suppliers to supply wing tools with built-in sensor or scanner mounts, with or without the sensor or scanner attached. In other embodiments, the wing tools and work vessels may be trailer-mountable and transportable.

What is claimed is:

1. A system comprising:

a) a first work vessel and a wing tool operable from the first work vessel, the wing tool comprising one or more thrusters having power and capacity to fluidize sediments from a first seabed location and move the fluidized sediments to a second seabed location, the second seabed location including a depression designed for the collection, concentration and extraction of bottom sediment material previously made by the wing tool or an extraction pump, the depression allowing a settling period between fluidized sediment arrival and extraction pumping during which gravitational settlement of the fluidized sediment creates a denser extraction stream with less water;

b) a second work vessel comprising the extraction pump, the extraction pump operable from the second work vessel and having capacity to pump at least a portion of the denser extraction stream from the depression and form a collected sediment comprising sand, fine grain materials, and water; and c) the first work vessel and/or the second work vessel comprise a hull that is configured to be disassembled and transportable on one or more trucks.

2. The system of claim 1 comprising one or more separation units.

3. The system of claim 1 comprising wherein the first work vessel and/or the second work vessel comprise a hull that may be disassembled and transportable on one or more trucks or in one or more shipping containers.

4. The system of claim 1 comprising one or more sensors, cameras, or lights located on the wing tool configured to sense location, attitude/orientation, distance, turbidity, depth, metal, presence of cables and pipelines, presence of archeological sites, presence of sunken vessels.

5. The system of claim 1 wherein the wing tool comprises an instrument compartment for scanning sonar, sonar altimeter, dual axis inclinometer altimeters.

6. The system of claim 1 comprising one or more work vessels other than the first and second work vessels for placement of collected sediments.

7. The system of claim 6 comprising auxiliary equipment selected from one or more auxiliary tanks, one or more auxiliary pumps, one or more auxiliary gas separators, and combinations thereof.

8. The system of claim 1 wherein the wing tool comprises a structural tubular framework supporting structural plates on all sides except a top of a center section to allow free motion of a gimbal, single point suspension.

9. The system of claim 1 wherein the wing tool is an all-plate design.

10. The system of claim 1 wherein the wing tool is suspended from the first vessel by a four point suspension system.

11. The system of claim 8 wherein the gimbal, single point suspension is configured to be operated via one or more hydraulic cylinders or electrically driven screw turnbuckles mounted on the wing tool, allowing the wing tool to pitch and roll during submerged operation from controls on the first vessel.

12. A system comprising:

a) a first work vessel;

b) a wing tool operable from the first work vessel using one or more wing tool orientation components selected from a set or sets of cables, winches, and chains, and one or more umbilicals for powering, controlling, and/or communicating with the wing tool, the wing tool comprising one or more thrusters having sufficient power and capacity to fluidize sediments from a first seabed location and move the fluidized sediments to a second seabed location, the second seabed location including a depression designed for the collection, concentration and extraction of bottom sediment material, the depression having been made by the wing tool or an extraction pump, the depression allowing a settling period between fluidized sediment arrival and extraction pumping during which gravitational settlement of the fluidized sediment creates a denser extraction stream with less water;

c) a second work vessel comprising the extraction pump; and d) the extraction pump operable from the second work vessel and having capacity to pump at least a portion of the denser extraction stream from the depression and form a collected sediment comprising sand, fine grain materials, and water;

e) the first work vessel and/or the second work vessel comprise a hull that is configured to be disassembled and transportable in one or more shipping containers or on one or more trucks.

13. The system of claim 12 comprising one or more separation units.

14. The system of claim 12 wherein the wing tool comprises an instrument compartment comprising one or more instruments selected from scanning sonar, sonar altimeter, and dual axis inclinometer altimeters.

15. The system of claim 12 comprising one or more work vessels other than the first and second work vessels for placement of collected sediments.

16. The system of claim 15 comprising auxiliary equipment selected from one or more auxiliary tanks, one or more auxiliary pumps, one or more auxiliary sediment separators, and combinations thereof.

17. The system of claim 12 wherein the wing tool comprises a structural tubular framework supporting structural plates on all sides except a top of a center section to allow free motion of a gimbal, single point suspension.

18. The system of claim 12 wherein the wing tool is suspended from the first vessel by a four point suspension system.

19. The system of claim 17 wherein the gimbal, single point suspension is configured to be operated via one or more hydraulic cylinders or electrically driven screw turnbuckles mounted on the wing tool, allowing the wing tool to pitch and roll during submerged operation from controls on the first vessel.

20. The system of claim 13 wherein the one or more separation units that separates the sand from the fine grain materials and water from the collected sediment are selected from:

a) mobile or non-mobile modular units designed to be mounted on a standard 50 foot trailer or designed to be transported within 20 to 40 foot standard ISO certified containers, comprising mechanical separation technology selected from elliptical shakers, linear shakers, and hydrocyclones;

b) a two phase de-sanding unit;

c) a three phase cleaning unit featuring dewatering, desilting, and desanding;

d) a single phase de-silting unit; and e) a de-sanding unit and a desilting unit configured to be operated in series for three phase cleaning.

* * * * *